US005411558A

United States Patent [19]

Taniguchi et al.

[11] Patent Number: 5,411,558

[45] Date of Patent: May 2, 1995

[54] HEAVY OIL EMULSION FUEL AND PROCESS FOR PRODUCTION THEREOF

[75] Inventors: Takao Taniguchi; Masanori Iizuka; Kazuo Isobe; Sayuri Tamaki, all of Wakayama; Shinichi Satake; Tadakazu Yamashita, both of Kanagawa, all of Japan

[73] Assignees: Kao Corporation; Nippon Oil Company, Limited, both of Tokyo, Japan

[21] Appl. No.: 112,146

[22] Filed: Aug. 26, 1993

[30] Foreign Application Priority Data

Sep. 8, 1992 [JP] Japan ..... 4-239372
Sep. 24, 1992 [JP] Japan ..... 4-254798

[51] Int. Cl.[6] ..... C10L 1/32

[52] U.S. Cl. ..... 44/301; 252/312; 252/314

[58] Field of Search ..... 44/301; 252/312, 314

[56] References Cited

U.S. PATENT DOCUMENTS 4,801,304 1/1989 Polanco et al. .
4,934,398 6/1990 Chirinos et al. .
5,000,757 3/1991 Puttock et al. ..... 44/301
5,024,676 6/1991 Moriyama et al. ..... 44/301

FOREIGN PATENT DOCUMENTS 53-104434 2/1977 Japan .
397788 4/1991 Japan .

*Primary Examiner*—Jacqueline V. Howard
*Attorney, Agent, or Firm*—Birch, Stewart, Kolasch & Birch

[57] ABSTRACT

An oil-in-water type heavy oil emulsion fuel having a specific and broad particle size distribution which has a viscosity close to that of water, can be sufficiently atomized at a temperature of room temperature to 90° C., is excellent in the handleability and fluidity, despite a very high heavy oil concentration, and has a very excellent stability such that neither precipitation nor increase in the viscosity occurs even after storage for a long period of time is prepared according to the present invention. Oil-in-water type heavy oil emulsion fuel according to the present invention can be used as a substitute fuel for heavy fuel oil without modification of the boilers. Further, the combustion efficiency of the heavy oil emulsion fuel according to the present invention is high and it is possible to reduce the amount of nitrogen oxides and sulfur oxides after combustion.

36 Claims, No Drawings

HEAVY OIL EMULSION FUEL AND PROCESS FOR PRODUCTION THEREOF

BACKGROUND OF THE INVENTION

1. Field of the Invention

The present invention relates to a heavy oil emulsion fuel of an oil-in-water type. More particularly, the present invention is concerned with an aqueous emulsion composition of a heavy oil having a particular particle size distribution and having a high heavy oil concentration, a low viscosity and an excellent storage stability and an aqueous emulsion composition of a heavy oil comprising a fatty acid distillation bottom or an edible oil, having an excellent storage stability and being non-pollutive.

Furthermore, the present invention relates to a process for producing the heavy oil emulsion fuel described above.

2. Description of the Related Art

In recent years, there has occurred a demand for the development of an alternate energy source as a substitute for petroleum which has been used in the largest quantities as an energy source. This demand is due to the limitation of the oil reserve and an increase in the oil price accompanying the same. Under the above-described circumstances, studies have been made with respect to the conversion of heavy oils, such as oil sand and bitumens, as new fossil fuel resources and distillation residues of petroleum and asphalt, into fuel.

However, these heavy oils are usually an oleaginous material containing about 60 to 70% or, in some cases, 70% or more of a heavy faction having a boiling point of 420° to 450° C. or, in some cases, 450° C. or above, which is usually a vacuum distillation residue. As a result, they do not flow, or have a viscosity as high as tens of thousands of centipoises or more. For this reason, when the use thereof as a fuel is intended without heating them to a temperature as high as 280° to 300° C., not only do problems occur in handling, atomization, etc., but also problems of clogging the piping, etc., of boilers renders them very difficult to use.

These heavy oils have higher residual carbon and nitrogen contents than those of gas oil, kerosine and fuel oil generally used as a fuel and, when used as a fuel, have a serious problem that the contents of the soot and dust and the nitrogen oxides in the exhaust gases are increased.

Under these circumstances, emulsion fuels comprising a heavy oil have been proposed and oil-in-water type emulsions having a high oil concentration have also been studied [see, for example, U.S. Pat. Nos. 4,249,554 (published on Feb. 10, 1981; Assignee: Conoco Inc.), 4,776,977 (published on Oct. 11, 1988; Assignee: The British Petroleum Company p.l.c.), 4,923,483 (published on May 8, 1990; Assignee: Intevep,S.A.), 4,934,398 (published on Jun. 19, 1990; Assignee: The British Petroleum Company p.l.c.), 4,943,390 (published on Jul. 24, 1990; Assignee: Petroleum Fermentations, N.V.) and 5,024,676 (published on Jun. 18, 1991; Assignee: Kao Corporation and Mitsubishi Jukogyo Kabushiki Kaisha), and Japanese Patent Publication-A Nos. 104,434/1978 (published on Sep. 11, 1978) and 97,788/1991 (published on Apr. 23, 1991)].

In these emulsion fuels, however, no study is made on the regulation of the particle diameter of the oil phase comprising the heavy oil. Therefore, it is a matter of course that there is a limitation on the increase in the concentration of the heavy oil component and the storage stability, so that these fuels cannot be said to be satisfactory fuels. In some emulsion fuels, the use of an expensive surfactant in a large amount is essential, which leads to a problem of the cost performance of the fuel, so that such emulsion fuels are unsuitable for practical use. Further, each time the place of origin or composition of the heavy oil varies, the kind or amount of addition of the surfactant must be varied, which renders such emulsion fuels unsuitable for practical use from this viewpoint.

Meanwhile, in view of the problem of environmental pollution, waste oil discharged from fast-food shops and confectioneries, which are waste oils derived from edible oils, and which are believed to be used in an amount of several million tons a year in recent years all over the country, have come to be recovered as a recovered oil. In the future, further improvements in the recovery of the waste oil are expected. However, the development of useful applications of the recovered oil has not been made, so that the development of applications of the recovered oil from the viewpoint of the utilization of resources, has been desired in the art.

Disclosure of the Invention

Summary of the Invention

As a result of extensive studies, the present inventors have found that the particle size distribution of the oil phase comprising a heavy oil is a very important factor and there exists an optimal particle size distribution for use of a heavy oil as an emulsion fuel, which has led to the completion of an oil-in-water type heavy oil emulsion fuel that has a viscosity relatively close to that of water, can be sufficiently atomized at a temperature of room temperature to 90° C., is excellent in handleability and fluidity despite a very high heavy oil concentration, and has a very excellent stability, such that neither sedimentation nor an increase in the viscosity occurs, even after storage for a long period of time.

Thus, the present invention relates to an oil-in-water type heavy oil emulsion fuel comprising (a) a heavy oil, (b) a surfactant and (c) water, wherein oil particles having a diameter of 100 μm or less account for 80% by weight or more of all the oil particles and the oil particles have a particle size distribution such that the distribution constant, n, determined from two relational expressions obtained by substituting a particle diameter (μm) corresponding to a cumulative oversize weight of 10% and a particle diameter (μm) corresponding to a cumulative oversize weight of 90% for a Rosin-Rammler distribution function expressed by the equation (1) is in the range of from 0.5 to 1.6:

$$R_{(D)}=100\exp\{-(D/D_c)^n\} \quad (1)$$

wherein R represents a cumulative oversize weight in %, D represents a particle diameter, n represents a constant (a distribution constant) and $D_c$ represents a constant (a particle size characteristic constant).

In other words, the present invention is an oil-in-water emulsion fuel comprising three components of (a) a heavy oil, (b) a surfactant and (c) water, characterized in that oil particles of component (a) having a diameter of 100 μm or less account for 80% by weight or more and, in a Rosin-Rammler distribution function expressed by the equation (1), the oil particles have a particle size distribution such that the distribution constant, n, determined from two points of a particle diameter (μm) corresponding to a cumulative oversize weight of 10% and a particle diameter (μm) corresponding to a cumulative oversize weight of 90% is in the range of from 0.5 to 1.6:

$$R_{(D)}=100\exp\{-(D/D_c)^n\} \quad (1)$$

wherein R represents a cumulative oversize weight in %, D represents a particle diameter, n represents a constant (a distribution constant) and $D_c$ represents a constant (a particle size characteristic constant).

With respect to the Rosin-Rammler distribution function, reference may be made to, for example, "Funtai Kogaku Binran (Handbook of Powder Technology)" edited by the Society of Powder Technology, Japan, published by The Nikkan Kogyo Shinbun, Ltd. on Feb. 28 1986 (the First Edition), pp. 7–11, authored by Shigeo Miwa and Jusuke Hidaka.

Further, the present inventors have made extensive studies and, as a result, have found that an oil-in-water type heavy oil emulsion fuel comprising a heavy oil, water and a fatty acid distillation bottom and/or a product obtained by reacting a fatty acid distillation bottom with a neutralizing agent or saponifier has a viscosity relatively close to that of water, can be sufficiently atomized at a temperature of room temperature to 90° C. is excellent in handleability and, by virtue of the effect of incorporation of the fatty acid distillation bottom or the product described above, is excellent in fluidity despite a very high concentration, and has such an excellent stability that neither sedimentation nor increase in the viscosity occurs even after storage for a long period of time. Further, it has been found that the effect of incorporation of the fatty acid distillation bottom or the product described above can contribute to a significant reduction in the contents of the soot and dust and the nitrogen oxides present in the exhaust gases and, hence, can render the emulsion fuel nonpollutive.

Thus, the present invention relates to an oil-in-water type heavy oil emulsion fuel comprising (a) a heavy oil, (c) water and (e-1) a fatty acid distillation bottom, and an oil-in-water type heavy oil emulsion fuel comprising (a) a heavy oil, (c) water and (b-1-1) a product obtained by reacting (e-1) a fatty acid distillation bottom with (f) a neutralizing agent or saponifier.

Furthermore, the present inventors have made extensive studies and, as a result, have developed a fuel which serves as a substitute for fuel oil and is composed mainly of a heavy oil, which has been desired to be utilized as a new fossil fuel, and an edible oil.

Thus, the present invention relates to an oil-in-water type heavy oil emulsion fuel comprising (a) a heavy oil, (c) water and (e-2) an edible oil, and an oil-in-water type heavy oil emulsion fuel comprising (a) a heavy oil, (c) water and (b-1-2) a product obtained by reacting (e-2) an edible oil with (f) a neutralizing agent or saponifier.

In addition, as a result of extensive studies, the present inventors have found that a heavy oil can be emulsified and dispersed, without using any surfactant, by the use of a precursor of a particular emulsifier comprising a compound having a carboxyl group in its molecule or a precursor of the emulsifier comprising an ester and a neutralizing agent or a saponifier for the precursor. Also, the present inventors have completed a process for producing an oil-in-water type heavy oil emulsion fuel which is excellent in fluidity despite a very high heavy oil concentration by virtue of a particular particle size distribution of its oil phase and has such an excellent stability that neither sedimentation nor increase in the viscosity occurs, even after storage for a long period of time.

Furthermore, the present invention relates to a process for producing an oil-in-water type heavy oil emulsion fuel which comprises producing an emulsion from 60 to 85% by weight of (a) a heavy oil, 10 to 40% by weight of (c) water, 0.01 to 10% by weight of (e) a precursor of an emulsifier comprising a compound having a carboxyl group in its molecule or an ester, and 0.01 to 5% by weight of (f) a neutralizing agent or saponifier for the precursor (e) while reacting the precursor (e) with the neutralizing agent or saponifier (f) to form an emulsifier.

In addition, the present invention relates to a process for producing an oil-in-water type heavy oil emulsion fuel in which oil particles having a diameter of 100 μm or less account for 80% by weight or more of all the oil particles in the emulsion and the oil particles in the emulsion have a particle size distribution such that the distribution constant, n, determined from two relational expressions obtained by substituting a particle diameter (μm) corresponding to a cumulative oversize weight of 10% and a particle diameter (μm) corresponding to a cumulative oversize weight of 90% for a Rosin-Rammler distribution function expressed by the equation (1) is in the range of from 0.5 to 1.8:

$$R_{(D)}=100\exp\{-(D/De)^n\} \quad (1)$$

wherein $R_{(D)}$ represents a cumulative oversize weight in %, D represents a particle diameter, n represents a constant (a distribution constant), and De represents a constant (a particle size characteristic constant).

Further scope and the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Detailed Description of the Invention

First, the components which are contained in the emulsion fuel according to the present invention will be described.

The "heavy oil" to be used as component (a) in the present invention includes the following oils which do not flow unless they are heated to high temperature, since they have poor flowability at ordinary temperatures.

(1) Petroleum-derived asphalt and a mixture containing the asphalt.

(2) Products, intermediate products and residues of various treatments of petroleum-derived asphalt, and mixtures containing one or more of them.

(3) High pour point oils which do not flow at ordinary temperatures.

(4) Petroleum-derived tar pitch and a mixture containing tar pitch.

(5) Bitumens, natural asphalts and Orinoco tar.

As the heavy oil, those containing components having a boiling point of 340° C. or above under atmospheric pressure in an amount of 90% by weight or more are preferable.

The surfactant to be used as component (b) in the present invention includes nonionic surfactants, anionic surfactants, cationic surfactants and amphoteric surfactants. Examples of the surfactants include the following.

<Nonionic surfactant>

(i) An alkylene oxide adduct of a compound having a phenolic hydroxyl group, such as phenol, cresol, butylphenol, nonylphenol, dinonylphenol, dodecylphenol, p-cumylphenol or bisphenol A, wherein the alkylene oxide is ethylene oxide, ethylene oxide/propylene oxide, ethylene oxide/butylene oxide or ethylene oxide/styrene oxide.

(ii) An alkylene oxide adduct of a formaldehyde condensate of a compound having a phenolic hydroxyl group, such as an alkylphenol, phenol, m-cresol, styrenated phenol or benzylated phenol, wherein the average degree of condensation is 1.2 to 100, preferably 2 to 20, and the alkylene oxide is ethylene oxide, ethylene oxide/propylene oxide, ethylene oxide/butylene oxide or ethylene oxide/styrene oxide.

(iii) An alkylene oxide adduct of a monohydric aliphatic alcohol and/or an aliphatic amine having 2 to 50 carbon atoms, wherein the alkylene oxide is ethylene oxide, ethylene oxide/propylene oxide, ethylene oxide/butylene oxide or ethylene oxide/styrene oxide.

(iv) A product of a block or random addition polymerization of ethylene oxide/propylene oxide, ethylene oxide/butylene oxide, ethylene oxide/styrene oxide, ethylene oxide/propylene oxide/butylene oxide or ethylene oxide/propylene oxide/styrene oxide.

(v) An alkylene oxide adduct of a polyhydric alcohol, such as glycerol, trimethylolpropane, pentaerythritol, sorbitol, sucrose, polyglycerol, ethylene glycol, polyethylene glycol, propylene glycol or polypropylene glycol, or an ester of the above-described polyhydric alcohol with a fatty acid having 8 to 18 carbon atoms, wherein the alkylene oxide is ethylene oxide, ethylene oxide/propylene oxide, ethylene oxide/butylene oxide or ethylene oxide/styrene oxide.

(vi) An alkylene oxide adduct of a polyamine having a plurality of active hydrogen atoms, such as ethylenediamine, tetraethylenediamine or polyethyleneimine (molecular weight: 600 to 10,000), wherein the alkylene oxide is ethylene oxide, ethylene oxide/propylene oxide, ethylene oxide/butylene oxide or ethylene oxide/styrene oxide.

(vii) A product prepared by the addition reaction of an alkylene oxide with a mixture of 1 mol of a fat and oil comprising a triglyceride with 0.1 to 5 mol of a polyhydric alcohol and/or water, which alcohol is selected from the group consisting of glycerol, trimethylolpropane, pentaerythritol, sorbitol, sucrose, ethylene glycol, polyethylene glycol having a molecular weight of 1000 or less, propylene glycol and polypropylene glycol having a molecular weight of 1000 or less, wherein the alkylene oxide is ethylene oxide, ethylene oxide/propylene oxide, ethylene oxide/butylene oxide or ethylene oxide/styrene oxide.

Preferable examples of the nonionic surfactants include those belonging to groups (i), (ii), (iii) and (iv) described above.

<Anionic surfactant>

(I) A sulfonic acid of an aromatic ring compound such as naphthalene, alkylnaphthalene, alkylphenol and alkylbenzene or a salt thereof, or a formalin (or a formaldehyde) condensate of a sulfonic acid of an aromatic ring compound or a salt thereof, wherein the average degree of condensation of formalin is 1.2 to 100 and the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt.

(II) Ligninsulfonic acid, a salt thereof or a derivative thereof, or a formalin (or a formaldehyde) condensate of ligninsulfonic acid and a sulfonic acid of an aromatic compound such as naphthalene or alkylnaphthalene, or a salt thereof, wherein the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt and the average degree of condensation of formalin is 1.2 to 50.

(III) Polystyrenesulfonic acid or a salt thereof, or a copolymer of styrenesulfonic acid with other comonomer(s) or a salt thereof, wherein the molecular weight is 500 to 500,000 and the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt.

(IV) A polymer of dicyclopentadienesulfonic acid or a salt thereof, wherein the molecular weight is 500 to 500,000 and the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt.

(V) A copolymer of maleic anhydride or/and itaconic anhydride with other comonomer(s), or a salt thereof, wherein the molecular weight is 500 to 500,000, and the salt is an ammonium salt or an alkali metal salt such as a sodium or potassium salt.

(VI) A maleinized liquid polybutadiene or a salt thereof, wherein the molecular weight of the liquid polybutadiene as the starting material is 500 to 200,000, and the salt is an ammonium salt or an alkali metal salt, such as a sodium or potassium salt.

(VII) An anionic surfactant having in its molecule one or two hydrophilic groups and selected from the group consisting of the following groups (a) to (h).

(a) a sulfuric ester salt of an alcohol having 4 to 18 carbon atoms, wherein the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

(b) An $C_{4-18}$ alkane-, alkene- or alkylarylsulfonic acid or a salt thereof, wherein the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

(c) a sulfate or phosphate of an adduct of a compound having in its molecule at least one active hydrogen with an alkylene oxide or a salt thereof, wherein the salt is an ammonium, sodium, potassium, magnesium or calcium salt;

(d) a sulfosuccinic acid ester salt of a saturated or unsaturated alcohol having 4 to 22 carbon atoms, wherein the salt is an ammonium, sodium or potassium salt;

(e) an alkyldiphenyletherdisulfonic acid or a salt thereof, wherein the alkyl group has 8 to 18 carbon atoms, and the salt is an ammonium, sodium, potassium, magnesium or calcium salt;

(f) a rosin (or a rosin acid or a resin acid) or a salt thereof, wherein the salt is an ammonium, sodium or potassium salt, which includes, for example, a mixed tall acid comprising a tall rosin and a tall oil fatty acid, i.e., a higher fatty acid, a tall rosin, a gum rosin, a wood rosin and salts thereof;

(g) an $C_{4-18}$ alkane or alkene fatty acid or a salt thereof, wherein the salt is an ammonium, potassium or sodium salt; and (h) an α-sulfofatty acid ester salt represented by the following general formula:

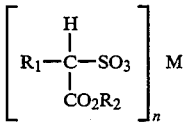

wherein $R_1$ represents an alkyl- or alkenylgroup having 6 to 22 carbon atoms, $R_2$ represents an alkyl group having 1 to 22 carbon atoms, M represents an alkali metal ion, an alkaline earth metal ion, an ammonium ion or an organic amine, and n is 1 or 2.

Preferable examples of the anionic surfactants include those belonging to groups (I), (II), (III), (IV) and (VII) described above.

<Cationic surfactant and Amphoteric surfactant>

(XI) An alkyl- or alkenylamine salt produced by neutralizing an alkyl- or alkenylamine having 4 to 18 carbon atoms with an inorganic or organic acid;

(XII) A quaternary ammonium salt represented by the following formulae (1), (2) or (3):

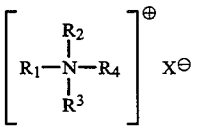

(1)

wherein $R_1$, $R_2$, $R_3$ and $R_4$ represent each an alkyl or alkenyl group having 1 to 18 carbon atoms and $X^{\theta}$ represents a counter anion, e.g., a chlorine ion and a bromine ion,

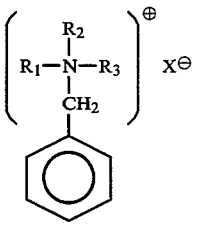

(2)

wherein $R_1$, $R_2$, $R_3$ and $X^{\theta}$ are as defined above, and

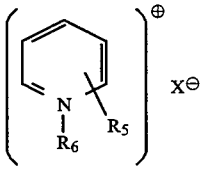

(3)

wherein $R_5$ represents an alkyl or alkenyl group having 8 to 18 carbon atoms, $R_6$ represents a hydrogen atom or a methyl group and $X^{\theta}$ is as defined above.

(XIII) An alkyl- or alkenylbetaine represented by the following formula:

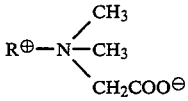

wherein R represents an alkyl or alkenyl group having to 18 carbon atoms.

(XIV) An alkyl- or alkenylamine oxide represented by the following formula:

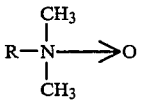

wherein R is as defined above.

(XV) An alkyl- or alkenylalanine represented by the following formula:

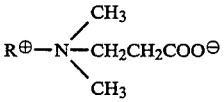

wherein R is as defined above.

(XVI) A polyamine represented by the following formulae (4) or (5):

$$RNHC_3H_6NHY \quad (4)$$

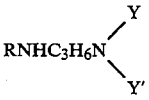

(5)

wherein R is as defined above and Y and Y' each represent an oxyethylene chain represented by the formula $-C_2H_4O)_mH$ wherein m is 1 to 50.

(XVII) A polyamine salt represented by the following formulae (6) or (7):

$$RNHC_3H_6NH_2X' \quad (6)$$

$$RNHC_3H_6NHC_3H_6NH_2X' \quad (7)$$

wherein R is as defined above and X' represents an inorganic or organic acid, e.g., hydrochloric acid and acetic acid.

(XVIII) An amphoteric imidazoline surfactant represented by the following formula:

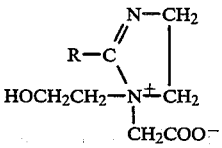

wherein R is as defined above.

(XIX) An amphoteric sulfobetaine surfactant represented by the following formula:

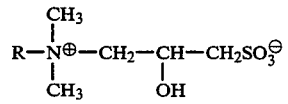

wherein R is as defined above.

Preferable examples of the cationic surfactants include those belonging to groups (XI), (XII), (XVI) and (XVII) described above.

The surfactant (b) includes a soap such as (b-1) a product obtained by reacting (e) a precursor with (f) a neutralizing agent or saponifier. Therefore, surfactants other than the product (b-1) are called component (b-2) in the present invention.

The precursor of an emulsifier as component (e) in the present invention is a compound having a carboxyl group in its molecule or an ester. The compound having a carboxyl group in its molecule is preferably at least one member selected from the group consisting of a chain monocarboxylic acid, a cyclic saturated fatty acid and a diterpenoid carboxylic acid. The ester as the precursor of the emulsifier includes triglycerides and examples thereof include an ester which can be decomposed into a compound having a carboxyl group in its molecule. The ester is preferably a natural fat or oil.

More specifically, preferred examples of the chain monocarboxylic acid include caprylic, captic, lauric, myristic, palmitic, stearic, behenic, oleic and linoleic acids, preferred examples of the cyclic saturated fatty acid include petroleum and naphthenic acids, preferred examples of the diterpenoid carboxylic acid include resin acid, rosin and abletic acid, and preferred examples of the natural fat and oil include coconut oil, palm kernel oil, babassu kernel oil, castor oil, linseed oil, lard, beef tallow, fish oil and tall oil. However, the precursor of the emulsifier is not limited to the abovedescribed specific examples only.

Furthermore, a fatty acid distillation bottom (e-1) and an edible fat and oil (e-2) are also one of the precursors (e).

In the present invention, the "fatty acid distillation bottom" as component (e-1) refers to a by-product generated in the production of fatty acids by using beef tallow, coconut oil, palm oil or the like as the raw material and is a "residuum" in the distillation according to the following general production process:

fat and oil→hydrogenation→hydrolysis→distillation→various fatty acids

Since the fatty acid distillation bottom contains many impurities and is poor in odor and hue, it has no value in use, so that it is currently disposed of as industrial wastes.

The composition of the fatty acid distillation bottom varies depending upon the kind of raw material and the production process and, hence, is not particularly limited. In many cases, the distillation bottom has an approximate composition comprising 10 to 90% by weight of a fatty acid, 90 to 10% by weight of a fatty acid ester and other impurities such as resinous substances, inorganic substances and metals.

The edible oil (e-2) to be used in the present invention may have the same composition as that of commercially available general edible oils. Although these fats and oils comprise various fatty acids, the content of $C_{18}$ (Cn: carbon atom number of the fatty acid) fatty acids is high and other constituent fatty acids include $C_{12}$, $C_{14}$, $C_{16}$, $C_{20}$, $C_{22}$, and $C_{24}$, fatty acids. In the present invention, among the edible oils, the recovered oil of edible fats and oils is preferably used from the viewpoint of the problem of resource and environment.

In the present invention, the "recovered oil of the edible fat and oil" is intended to mean recovered oils of used edible fats and oils, such as soybean oil, rapeseed oil and corn oil, that are discharged in a large amount from fast-food shops, confectioneries and the general household and have not been effectively used due to their odor and color. Although the acid value of the edible oil is generally 1 or less, the recovered oil exhibits an acid value as large as 1 to 30 due to the progress of rancidillcation. Regarding other properties, the recovered oil has a saponification value of about 50 to 250 and an iodine value of about 10 to 150. These properties often somewhat change as compared with those before use.

The neutralizing agent or saponifier as component (f) includes, for example, a hydroxide of an alkali metal, ammonia and an amine. Preferred examples thereof include a baslc compound (f-1) such as KOH. These compounds react with the fatty acids in the fatty acid distillation bottom or the edible oil to form a soap. Namely, these compounds serve as a neutralizing agent and a saponifier. Therefore, component (f) is called as a neutralizing agent or saponifier in the present invention. The soap produced serves as a surfactant.

Water as component (c) includes city water, deionized water and so on.

The water-soluble polymer as component (d) and the polyhydric alcohol as component (g) are stabilizers for an emulsion.

The water-soluble polymer includes water-soluble synthetic polymers and water-soluble polymers derived from naturally occurring matter (including microorganisms). It is preferred to use the water-soluble synthetic polymers in the present invention. Specific examples of the water-soluble polymer are as follows:

<Water-Soluble Synthetic Polymers>

(a) A homopolymer or copolymer of acrylic acid or a derivative thereof represented by the following formula:

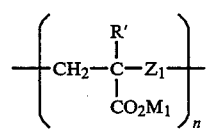

wherein R′ represents a hydrogen atom, a methyl group or an ethyl group; $M_1$ represents a hydrogen atom, a sodium ion, a potassium ion, a lithium ion or an ammonium ion; $Z_1$ represents a divalent group derived from a monomer represented by the formula:

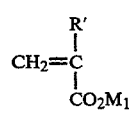

(wherein R′ and $M_1$ are as defined above), a comonomer copolymerizable with the monomer or a salt of the comonomer, for example, maleic acid (anhydride), itaconic acid (anhydride), α-olefin, acrylamide, vinylsulfonic acid, allylsulfonic acid, methallylsulfonic acid, acrylamidomethylpropylsulfonic acid or a salt ($NH_4$, Na, K or Li) thereof, a dialkyl(methyl or ethyl)aminoethylmethacrylate or a salt (chloride, diethylsulfate or dimethylsulfate) thereof; and n is 50 to 100,000.

(b) A homopolymer or copolymer of acrylamide or a derivative thereof represented by the following formula:

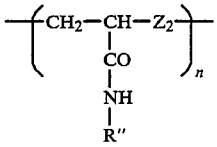

wherein R'' represents a hydrogen atom or a $C_2H_4OH$ group; $Z_2$ represents a divalent group derived from a monomer represented by the formula:

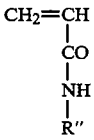

(wherein R'' is as defined above), a comonomer copolymerizable with the monomer or a salt of the comonomer, for example, vinylsulfonic acid, allylsulfonic acid, methallylsulfonic acid, acrylamidomethylpropylsulfonic acid or a salt ($NH_4$, Na, K or Li) thereof, a dialkyl(methyl or ethyl)aminoethylmethacrylate or a salt (chloride, dimethylsulfate or diethylsulfate) thereof, styrene, α-olefins ($C_{2-18}$) and vinylallyl alcohol; and n is 50 to 100,000.

(c) A homopolymer of maleic anhydride or iraconic anhydride, or a copolymer thereof represented by the following formula:

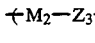

wherein $M_2$ represents a maleic anhydride or itaconic anhydride residue; $Z_3$ represents an α-olefin (ethylene, propylene, butylene, isobutylene, octene, decene, dodecene or the like) or styrene residue; and n is 50 to 100,000.

(d) A homopolymer of vinyl alcohol, or a copolymer thereof represented by the following formula:

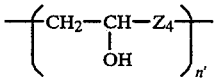

wherein $Z_4$ represents a vinyl acetate or styrerne residue; and n' is 30 to 100,000.

(e) A homopolymer of vinylpyrrolidone, or a copolymer thereof represented by the following formula:

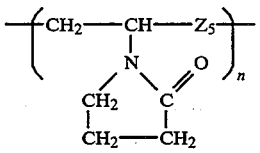

wherein $Z_5$ represents a divalent group derived from a comonomer copolymerizable with vinylpyrrolidone or a salt ($NH_4$, Na, K or Li) thereof, for example, acrylamide, vinylsulfonic acid, methallylsulfonic acid, maleic anhydride, iraconic anhydride or a salt ($NH_4$, Na, K or Li) thereof, styrene, α-olefin ($C_{2-18}$) or the like; and n is 50 to 100,000.

(f) A polyalkylene oxide having a molecular weight of 10,000 to 5,000,000 (wherein the ethylene oxide content is 95% or more). It may contain in its molecule 5% or less of a block polymer of propylene oxide, butylene oxide or styrene oxide, or an alkylaryl or alkyl group.

Preferable examples of the water-soluble synthetic polymers include those belonging to groups (a), (b), (d) and (f) described above.

<Water-Soluble Polymers Derived from Naturally Occurring Matter>

(A) Hydrophilic Polymers Derived from Microorganisms
(Polysaccharides)
(a) xanthan gum
(b) pullulan
(c) dextran (B) Hydrophilic Polymers Derived from Plants
(Polysaccharides)
(a) Derived from marine algae:
(i) agar
(ii) carrageenan
(iii) furcellaran
(iv) alginic acid and salts (Na, K, $NH_4$, Ca or Mg) thereof
(b) Derived from seeds:
(i) locust bean gum
(ii) guar gum
(iii) tara gum
(iv) tamarind gum
(c) Trees (exudates):
(i) gum arabic
(ii) gum karaya
(iii) gum tragacanth
(d) Derived from fruits:
(i) pectin (C) Hydrophilic Polymers Derived from Animals
(Proteins)
(i) gelatin
(ii) casein (D) Naturally Occurring Polymer Derivatives
(i) cellulose derivatives (such as carboxymethylcellulose)
(ii) chemically modified starch Preferable examples of the water-soluble polymers derived from naturally occurring matter include those belonging to groups (A), (B)-(b), (B)-(c) and (D) described above.

The polyhydric alcohol as component (g) is those having two or more of hydroxyl groups in its molecule and being soluble in water, and examples thereof include monosaccharides and polysaccharides, such as glycerol, polyglycerol, ethylene glycol, diethylene glycol, polyethylene glycol, propylene glycol, oligosaccharide, sorbitol and glucose.

First, the present invention provides an oil-in-water type heavy oil emulsion fuel comprising three components of (a) a heavy oil, (b) a surfactant and (c) water, wherein oil particles having a diameter of 100 μm or less account for 80% by weight or more of all the oil particles and the oil particles have a particle size distribution such that the distribution constant, n, determined from two relational expressions obtained by substituting a particle diameter (μm) corresponding to a cumulative oversize weight of 10% and a particle diameter (μm) corresponding to a cumulative oversize weight of 90% for a Rosin-Rammler distribution function expressed by the equation (1) is in the range of from 0.5 to 1.6:

$$R_{(D)}=100\exp\{-(D/D_c)^n\} \quad (1)$$

wherein R represents a cumulative oversize weight in %, D represents a particle diameter, n represents a constant (a distribution constant) and $D_c$ represents a constant (a particle size characteristic constant).

An emulsion comprising two liquids insoluble in each other, one of which is dispersed in a fine particle form in the other liquid, gives a thermodynamically unstable nonequilibrium system because the free energy of the interface of the two liquids increases with an increase in the area of the interface of the two liquids, so that the state of dispersion varies with time and the emulsion form is gradually broken. It is a common practice to use surfactants for the purpose of improving the stability of the system through a reduction in the free energy of the interface. No matter how high the performance of the surfactant is, the free energy of the interface cannot be reduced to zero, so that it is difficult to provide an emulsion having a truly good stability.

Accordingly, the present inventors have noted the physicochemical properties of the system and thought that, in order to increase the concentration of the emulsion, i.e., the concentration of the oil phase, it is necessary to minimize the proportion of gaps between particles (porosity) for enabling a heavy oil to be utilized or filled at a high density, thereby minimizing the amount of a solvent (water) necessary for fluidizing the emulsion and, further, in order to stabilize the system, it is necessary to minimize the increase in the area of interface of the heavy oil, i.e., the oil phase, and water to lower the free energy at the interface. Based on this concept, the present inventors have focused on the particle size distribution of the oil phase.

Specifically, it is optimal that the oil particles, that is, the oil droplets or the internal phases, have a particle size distribution such that the distribution constant, n, determined from two relational expressions obtained by substituting a particle diameter (μm) corresponding to a cumulative oversize weight of 10% and a particle diameter (μm) corresponding to a cumulative oversize weight of 90% for a Rosin-Rammler distribution function expressed by the equation (1) is in the range of from 0.5 to 1.6, preferably in the range of from 0.7 to 1.4, still preferably in the range of from 0.8 to 1.3.

When the distribution constant exceeds 1.6, that is, when the particle size distribution is narrower and sharper, the proportion of the gap between the particles (porosity) increases. This not only makes an increase in the concentration difficult, but also brings about an increase in the area of interface of the heavy oil, i.e., the oil phase, and the water, which increases the free energy of the interface, to remarkably lower the stability of the system.

When this value is smaller than 0.5, that is, the grain size distribution is broader, it becomes difficult to produce an emulsion and, at the same time, there occurs an increase in the proportion of the gap between the particles, which makes an increase in the concentration of the emulsion difficult.

The oil particles comprising the heavy oil have an average particle size preferably in the range of from 3 to 50 μm, still preferably in the range of from 3 to 30 μm, particularly preferably in the range of from 3. to 20 μm, and further should have a particle size distribution such that particles having a diameter of 100 μm or less account for 80% by weight or more of all the oil particles and, preferably, particles having a diameter of 1 μm or less is 15% by weight or less of all the oil particles. When coarse particles having a particle size larger than 100 μm are present in a large amount, the emulsion does not burn very well when it is used as a fuel, which lowers the combustion efficiency and causes precipitation to occur during storage or the clogging of piping, etc., of boilers.

In general, when the heavy oil is simply emulsified with an emulsifier, such as a homogenizer, or pulverized with a mill or the like, the resultant emulsion does not satisfy the above-described particle size distribution requirements and has a relatively narrow particle size distribution having a distribution constant, n, of about 1.8.

A heavy oil emulsion fuel having such a particle size distribution cannot provide an emulsion fuel having high concentration, low viscosity and excellent storage stability as contemplated by the present invention.

In the present invention, the particle size distribution was measured with a laser beam diffraction/scattering particle size distribution measuring device (LA700 manufactured by Horiba, Ltd.).

In order to provide an emulsion fuel having the above-described particle size distribution useable in the present invention, it is preferred to use a specially devised particle size regulation method rather than simple emulsification. Examples of the method include one which comprises using a plurality of emulsifiers in parallel and operating the emulsifiers with shear forces different from each other to produce emulsions different from each other in particle size distribution and mixing these emulsions to attain an optimal particle size distribution. Another method comprises varying the kind and amount of addition of the surfactant to produce emulsions different from each other in particle size distribution and mixing the emulsions to attain an optimal particle size distribution. Still another method comprises continuously producing an emulsion on a line mixer or the like, while circulating part of the emulsion, while regulating the amount and time of circulation, thereby providing an emulsion having a broad particle size distribution. An additional method comprises continuously producing an emulsion on a line mixer or the like while periodically varying the kind and/or amount of feed of the surfactant while regulating the cycle time according to the kind and/or amount of feed of the surfactant to provide an emulsion having a broad particle size distribution.

Emulsifiers or dispersing devices commonly used in the art, such as a homomixer, a homogenizer, a line mixer, a colloid mill, a sand mill, a milder, a static mixer and a motionless mixer, may be used as the emulsifier in the present invention.

The concentration of the heavy oil used as component (a) of tile emulsion fuel in the present invention is preferably in the range of from 60 to 85% by weight, still preferably in the range of from 65 to 80% by weight, particularly preferably in the range of from 70 to 75% by weight. When the heavy oil concentration is excessively low, the calorific power is lowered and, in some cases, it becomes difficult to conduct direct combustion. On the other hand, when the concentration is excessively high, the viscosity of the emulsion becomes so high that the fluidity is lowered and, at the same time, coalescence or agglomeration of the particles occurs during storage which causes a deterioration in its storage stability.

In the present invention, the surfactant as component (b) is at least one member selected from among nonionic, anionic, cationic and amphoteric surfactants.

The amount of use of the surfactant (b) is preferably in the range of from 0.01 to 5% by weight, still preferably in the range of from 0.05 to 3.0% by weight, particularly preferably in the range of from 0.1 to 1.0% by weight in the emulsion fuel, i.e., based on the entire amount of the emulsion fuel. When the amount is below the above-described range, the emulsification of the heavy oil and the development of the emulsification stability are unsatisfactory. On the other hand, when the amount is above the above-described range, the profitability is low and, further, foaming occurs during emulsification or the regulation of the particle diameter becomes difficult.

In the heavy oil emulsion fuel according to the present invention, the amount of introduced water as component (c) is important, and it is preferably 10 to 40% by weight, still preferably 15 to 35% by weight, particularly preferably 20 to 30% by weight. When the amount of water is below the above-described range, no improvement in the emulsification stability can be attained and only an emulsion having a poor fluidity is provided even though the particle size distribution of the oil phase is optimized or the kind and/or amount of use of the surfactant as component (b) is optimized. On the other hand, when the amount of water is above the above-described range, the calorific power as a fuel becomes so low that direct combustion becomes difficult. Therefore, the use of water in an amount outside the above-described range should be avoided.

In the present invention, if necessary, it is also possible to incorporate a water-soluble polymer as a component (d). Specifically, a water-soluble polymer having a molecular weight of 10,000 or more can be incorporated in an amount of preferably 0.005 to 3 parts by weight, still preferably 0.008 to 2 parts by weight, particularly preferably 0.01 to 1 part by weight based on 100 parts by weight of the entire amount of the components (a), (b) and (c) for the purpose of further improving the storage stability.

In the production of the emulsion fuel according to the present invention, the surfactant (b) is not an essential component. Thus, a precursor (e) of an emulsifier and a neutralizing agent or saponifier (f) can be used instead of the surfactant (b), and the precursor (e) is reacted with the neutralizing agent or saponifier (f) during emulsification to form a soap, that is surfactant (b).

The present invention also provides a process for producing an oil-in-water type heavy oil emulsion fuel which comprises producing an emulsion from 60 to 85% by weight, preferably 65 to 80% by weight, still preferably 70 to 75 by weight of a heavy oil (a), 10 to 40% by weight, preferably 15 to 35% by weight, still preferably 20 to 30 by weight of water (c), 0.01 to 10% by weight, preferably 0.05 to 5% by weight, still preferably 0.1 to 1.0 by weight of a precursor (e) of an emulsifier comprising a compound having a carboxyl group in its molecule or an ester, and 0.01 to 5% by weight of a neutralizing agent or saponifier (f) for the precursor (e), while reacting the precursor (e) with the neutralizing agent or saponifier (f) to form an emulsifier.

In the process according to the present invention, the emulsion to be obtained preferably has such properties that oil particles having a diameter of 100 μm or less account for 80% by weight or more of all the oil particles in the emulsion and the oil particles in the emulsion have a particle size distribution such that the distribution constant, n, determined from two relational expressions obtained by substituting a particle diameter (μm) corresponding to a cumulative oversize weight of 10% and a particle diameter (μm) corresponding to a cumulative oversize weight of 90% for a Rosin-Rammler distribution function expressed by the equation (1) described above is in the range of from 0.5 to 1.8, preferably in the range of from 0.5 to 1.6, still preferably in the range of from 0.7 to 1.6, particularly preferably in the range of from 0.8 to 1.5. That is, the above-described process is preferably conducted to produce an emulsion having the above-described properties.

A heavy oil emulsion fuel having such a broad particle size distribution that the distribution constant, n, is 1.8 or less can be produced by using a precursor (e) of a particular emulsifier comprising a compound having a carboxyl group in its molecule or a precursor (e) of the emulsifier comprising an ester and a neutralizing agent or saponifier (f) for the precursor and causing the heavy oil (a) to be emulsified and dispersed while reacting the precursor (e) with the neutralizing agent or saponifying agent (f) at a temperature in the range of from 80° to 200° C. to form an emulsifier, i.e., a soap.

It is believed that the emulsion fuel having the broad particle size distribution of the present invention is formed through the following mechanism.

In general, when an emulsion is produced by using a surfactant, the particle diameter of the oil particles of the emulsion depends upon the concentration of the surfactant, that is, the interfacial tension of the system. Specifically, when the concentration of the surfactant is low, the interfacial tension is so high that the particle diameter of the oil particles is large. On the other hand, when the concentration of the surfactant is high, the interfacial tension is so low that the particle diameter of the oil particles becomes small. In the process according to the present invention, the precursor of the surfactant reacts with the neutralizing agent during the emulsification to gradually release the surfactant into the system. Therefore, the concentration of the surfactant in the system gradually increases from zero and continues to increase until the reaction of the precursor with the neutralizing agent is completed. As a result, the interfacial tension of the system increases with time, which causes an emulsion having a broad particle size distribution, that is, containing oil particles having a wide range of particle diameters from a large particle diameter to a small particle diameter.

In the process according to the present invention, it is also possible to add additives, i.e., the precursor (e) and the neutralizing agent or saponifier (f), in the same manner as that used in the nascent soap method known in the art, that is, a method wherein a precursor (e) comprising a compound having a carboxyl group in its molecule or a precursor (e) comprising an ester is dissolved in the heavy oil (a) while the neutralizing agent or saponifier (f) is dissolved in water (c). An emulsion wherein a soap is formed at the interface, can be prodnced by mixing the two phases. What is particularly important in the present invention is that the surfactant should be gradually released into the system during the emulsification. In other words, the control of release of the surfactant is important. Factors for controlling the release of the surfactant include the reaction temperature, the reaction time, the shearing force in agitation for mixing and the reaction rate constant of the precursor. A heavy oil emulsion fuel having an intended broad distribution can be provided by controlling these factors.

The method for adding additives is not limited to the above-described method. Specifically, the precursor (e) comprising a compound having a carboxyl group in its molecule or the precursor (e) comprising an ester may be dispersed in water. Alternatively, the neutralizing agent or saponifier may be dissolved in the heavy oil. What is important is to form such a system that the precursor (e) comprising a compound having a carboxyl group in its molecule or the precursor (e) comprising an ester and the neutralizing agent or saponifier (f) coexist during the emulsification of water (c) and the heavy oil (a) to bring about a reaction for forming an emulsifier.

Examples of the The precursor (e) and the neutralizing agent or saponifier (f) are as described above.

The amount of the precursor (e) used is in the range from 0.01 to 10% by weight, preferably in the range of from 0.05 to 5% by weight, still preferably in the range of from 0.1 to 1.0% by weight in the emulsion fuel, i.e., based on the entire amount of the emulsion fuel. When the amount of use is below the above-described range, the emulsification of the heavy oil (a) and the development of the emulsification stability are unsatisfactory. On the other hand, the use of the precursor (e) in an amount exceeding the above-described range not only is unfavorable from the viewpoint of profitability but also produces foaming during the emulsification and often makes it difficult to regulate particle diameter.

The amount of use of the neutralizing agent or saponifier (f) is 0.01 to 5% by weight in the emulsion fuel, i.e., based on the entire amount of the emulsion fuel and preferably an amount necessary for neutralizing or saponifying the precursor (e) may be properly selected.

In the process according to the present invention, if necessary, surfactants, i.e., surfactants (b-2) described above, may be used in combination with the above-descried components, i.e., the heavy oil (a), water (c), the precursor (e) and the neutralizing agent or saponifier (f). The combined use of the surfactant (b-2) can contribute to a further improvement in the emulsifiability and emulsion stability. At least one member selected from the group consisting of surfactants (b-2) can be used. Namely, the surfactant (b-2) may be a nonionic surfactant, an anionic surfactant, a cationic surfactant, an amphoteric surfactant or a mixture of two or more surfactants. The amount of use of the surfactant (b-2) is in the range of from 0.01 to 5% by weight, preferably in the range of from 0.05 to 3% by weight, still prferably in the range of from 0.1 to 1.0% by weight base on the entire amount of the components (a), (c), (e) and (f).

In the process according to the present invention, if necessary, it is also possible to use a water-soluble polymer described above as a component (d). Specifically, a water-soluble polymer (d) having a molecular weight of 10,000 or more can be incorporated in an amount of 0.005 to 3 parts by weight, preferably 0.008 to 2 parts by weight, still preferably 0.01 to 0.5 part by weight based on 100 parts by weight of the entire amount of the components (a), (c), (e) and (f) for the purpose of further improving the storage stability.

The present invention further provides an oil-in-water type heavy oil emulsion fuel comprising three components of (a) a heavy oil, (c) water and (e-1) a fatty acid distillation bottom.

In general, the oil-in-water type heavy oil emulsion fuel described above further comprises, besides the components (a), (c) and (e-1), a surfactant, other than (b-1), i.e., a product obtained by reacting (e) a precursor with (f) a neutralizing agent or saponifier, i.e., a surfactant (b-2).

The oil-in-water type heavy oil emulsion fuel described above comprises preferably 40 to 85% by weight, still preferably 50 to 80% by weight, particularly preferably 60 to 75% by weight of the heavy oil as component (a), preferably 0.1 to 5% by weight, still preferably 0.2 to 3% by weight, particularly preferably 0.3 to 2% by weight of the surfactant as component (b-2), preferably 10 to 40% by weight, still preferably 15 to 35% by weight, particularly preferably 15 to 25% by weight of water as component (c) and preferably 0.1 to 50% by weight, still preferably 0.2 to 40% by weight, particularly preferably 0.3 to 30% by weight of the fatty acid distillation bottom as component (e-1).

Although the mechanism through which a long-term stability can be attained in the above-described present invention is not completely clear, it is believed to be as follows. An emulsion comprising two liquids insoluble in each other, one of which is dispersed in granular form in the other liquid, gives a thermodynamically unstable nonequilibrium system because the free energy of the interface of the two liquids increases with an increase in the area of the interface of the two liquids, so that the state of dispersion varies with time toward demulsification. It is a common practice to use surfactants for the purpose of improving the stability of a system through a reduction in the free energy of the interface. No matter how high the performance of the surfactant is, the free energy of the interface cannot be reduced to zero, so that it is difficult to provide an emulsion which is truly stable.

Accordingly, the present inventors have noted the interface of water (c) and the heavy oil (a) and, as a result, have found a fatty acid distillation bottom (e-1) as a compound which is less liable to dissolve in both the water and heavy oil phases. It is conceivable that the fatty acid distillation bottom (e-1) is preferentially distributed in the interfacial phase, which reduces the free energy of the interface of the water phase and the heavy oil phase and serves to enhance the stability of the system.

The amount of incorporation of the fatty acid distillation bottom (e-1) in the emulsion fuel is preferably in the range of from 0.1 to 50% by weight, still preferably in the range of from 0.2 to 40% by weight, particularly preferably in the range of from 0.3 to 30% by weight. When the amount of incorporation is below this range, the effect of imparting long-term stability is poor and it is difficult to attain the effect of reducing the contents of the soot and dust and the nitrogen oxides present in the exhaust gases. On the other hand, when this amount exceeds 50% by weight, the amount of inorganic substances and metals derived from the distillation bottom is increased, resulting in a composition unsuitable for use as a fuel.

The concentration of the heavy oil as component (a) of the emulsion fuel described above is preferably in the range of from 40 to 85% by weight, still preferably in the range of from 50 to 80% by weight, particularly preferably in the range of from 60 to 75% by weight. When the heavy oil concentration is excessively low, the calorific power is lowered and, in some cases, it becomes difficult to achieve direct combustion. On the other hand, when the concentration is excessively high, the viscosity of the emulsion fuel becomes so high that the fluidity is lowered and, at the same time, coalescence or agglomeration of the particles occurs during storage causing a deterioration in the storage stability.

In the present invention, the surfactant as component (b-2) is at least one member selected from among nonionic, anionic, cationic and amphoteric surfactants.

The amount of use of the surfactant (b-2) is preferably in the range of from 0.1 to 5% by weight, still preferably in the range of from 0.2 to 3.0% by weight, particularly preferably in the range of from 0.3 to 2.0% by weight in the emulsion fuel, i.e., based on the entire amount of the emulsion fuel. When the amount is below the above-described range, the emulsification of the heavy oil and the development of the emulsification stability are unsatisfactory. On the other hand, when the amount is above the above-described range, the profitability is low and, further, foaming occurs during emulsification or the regulation of the particle diameter becomes difficult.

In the heavy oil emulsion fuel according to the present invention, the amount of introduced water as component (c) is important, and it is preferably 10 to 40% by weight, still preferably 15 to 35% by weight, particularly preferably 15 to 25% by weight. When the amount of water is below the above-described range, no improvement in the emulsification stability can be attained and only an emulsion fuel-having a poor fluidity is provided, even though the particle size distribution of the oil phase is optimized or the kind and/or amount of use of the surfactant as component (b) is optimized. On the other hand, when the amount of water is above the above-described range, the calorific power as a fuel becomes so low that direct combustion becomes difficult. Therefore, the use of water in an amount outside the above-described range should be avoided.

In the present invention, if necessary, it is also possible to incorporate a water-soluble polymer (d) and/or a polyhydric alcohol (g) as a stabilizer. The water-soluble polymer (d) having a molecular weight of 10,000 or more can be incorporated in an amount of 0.005 to 3 parts by weight, preferably 0.008 to 2 parts by weight, particularly preferably 0.01 to 0.5 part by weight based on 100 parts by weight of the entire amount of the components (a), (b-2), (c) and (e-1) for the purpose of further improving the storage stability. The polyhydric alcohol (g) can be incorporated in an amount of 0.1 to 50 parts by weight, preferably 0.2 to 40 parts by weight, still preferably 0.3 to 30 parts by weight based on 100 parts by weight of the entire amount of the components (a), (b-2), (c) and (e-1) for the purpose of further improving the storage stability.

In the present invention, the fatty acid distillation bottom (e-1) can be incorporated by a method wherein the heavy oil (a) and the distillation bottom (e-1) are heated and mixed with each other before the production of an emulsion or a method wherein the distillation bottom (e-1) is added during the production of an emulsion. In any of these methods, since the distillation bottom (e-1) has a poor fluidity at room temperature, it is preferred to heat the distillation bottom (e-1) at 50° C. or above before the addition.

Further, in some cases, the emulsion to which the distillation bottom (e-1) has been incorporated is acidic. In this case, it is possible to neutralize the emulsion by adding an alkaline component thereto. A hydroxide of an alkali metal, ammonia and/or an amine are suitable as the neutralizing agent. The neutralizing agent may be dissolved in water before the production of the emulsion or alternatively may be added during the production of the emulsion. The amount of addition of the neutralizing agent is preferably such that the resultant emulsion is neutral or weakly alkaline.

The neutralizing agent reacts with the distillation bottom (e-1) to form a soap. Namely, the neutralizing agent serves also as a saponifier. Therefore, the neutralizing agent is the neutralizing agent or saponifier (f) described above.

When the neutralizing agent is used, the heavy oil emulsion fuel contains (b-1-1) a product obtained by reacting (e-1) a fatty acid distillation bottom with (f) a neutralizing agent or saponifier. In this case, the heavy oil emulsion fuel comprises components (a), (c), (e-1) and (b-1-1), or components (a), (c) and (b-1-1), depending on the amount of the neutralizing agent or saponifier (f).

According to the present invention, the mechanism for reduction of the contents of the soot and dust and the nitrogen oxides in the exhaust gases is not clear but it is thought as follows. Asphalts and bitumens as the heavy oil have higher residual carbon and nitrogen contents than those of gas oil, kerosine, fuel oil and other oils generally used as a fuel, so that when they are used as a fuel, an increase in the soot and dust and the nitrogen oxides is unavoidable. By contrast, in the fatty acid distillation bottom (e1) used in the present invention, the calorific value in the combustion is substantially equal to that of the heavy oil, but no significant amount of residual carbon and nitrogen is present. Therefore, the fuel NOx derived from nitrogen contained in the soot and dust and the fuel decreases with an increasing proportion of incorporation of the fatty acid distillation bottom (e-1) relative to the heavy oil.

Furthermore, the present invention provides an oil-in-water type heavy oil emulsion fuel comprising three components of (a) a heavy oil, (c) water and (e-2) an edible oil.

In general, the oil-in-water type heavy oil emulsion fuel described above further comprises, besides the components (a), (c) and (e-2), a surfactant other than (b-1) a product obtained by reacting (e) a precursor with (f) a neutralizing agent or saponifier, i.e., a surfactant (b-2).

The oil-in-water type heavy oil emulsion fuel described above preferably has the components (a), (b2), (c) and (e-2) the following ratio. Namely, the ratio of the entire amount of the components (a) and (e-2) to the amount of the component (c) is 60 to 90: 40 to 10 by weight, preferably 65 to 85: 35 to 15 by weight, still preferably 70 to 80: 30 to 20 by weight and the amount of the component (b-2) is 0.1 to 5% by weight, preferably 0.2 to 3% by weight, still preferably 0.3 to 2% by weight based on the entire amount of the components (a), (c) and (e-2).

The emulsion fuel described above has a viscosity relatively close to that of water, can be sufficiently atomized at a temperature of room temperature to 90° C. and is excellent in the handleability and, by virtue of the effect of incorporation of the edible oil (e-2), is further excellent in fluidity despite a very high heavy oil concentration, and has such an excellent stability that neither sedimentation nor increase in the viscosity occurs even after storage for a long period of time. Further, the emulsion fuel of the present invention is a nonpollutive fuel because the contents of the soot and dust and the nitrogen oxides in the exhaust gases are significantly reduced by virtue of the effect of incorporation of the edible oil (e-2).

Although the mechanism through which a long-term stability can be attained in the above-described present invention is not always understood, it is believed to be as follows.

As described above with respect to an emulsion fuel containing a fatty acid distillation bottom (e-1), an emulsion comprising two liquids insoluble in each other one of which is dispersed in granular form in the other liquid gives a thermodynamically unstable nonequilibrium system because the free energy of the interface of the two liquids increases with an increase in the area of the interface of the two liquids, so that the state of dispersion varies with time toward demulsification. It is a common practice to use surfactants for the purpose of improving the stability of the system through a reduction in the free energy of the interface. No matter how high the performance of the surfactant is, the free energy of the interface cannot be reduced to zero, so that it is difficult to provide an emulsion which is truly stable.

Accordingly, the present inventors have noted the interface of water (c) and the heavy oil (a) and assumed that the addition of an edible oil (e-2) causes fatty acid molecules contained in the edible oil (e-2) to be preferentially distributed to the interfacial phase, which reduces the free energy of the interface of the water and the heavy oil and serves to enhance the stability of the system.

In the emulsion fuel of the present invention, the weight ratio of the entire amount of the heavy oil (a) and the edible oil (e-2) to water (c) is in the range of from 60:40 to 90:10, preferably in the range of from 65:35 to 85:15, still preferably 70:30 to 80:20. When the proportion of the oil is excessively low, the calorific power of the fuel is lowered and, at the same time, it often becomes difficult to effect direct combustion. On the other hand, when the proportion of the oil is excessively high, the viscosity of the emulsion fuel becomes so high that the fluidity of the fuel is lowered and, at the same time, coalescence or agglomeration of the particles occurs during storage, which causes a deterioration in the storage stability.

The ratio of incorporation of the heavy oil (a) to this edible oil (e-2) is in the range of from 5:95 to 95:5, preferably in the range of from 20:80 to 80:20, still preferably in the range of from 30:70 to 70:30, from the viewpoint of combustibility. When the proportion of the heavy oil (a) is high, the amounts of fuel $NO_x$ and the soot and dust attributable to the heavy oil is increased. On the other hand, when the proportion of the edible oil (e-2) is high, the burning off of the fuel can be improved, but there occurs an increase in the thermal $NO_x$ attributable to a rise in the flame temperature.

The amount of use of the surfactant (b-2) is preferably in the range of from 0.1 to 5 parts by weight, still preferably in the range of from 0.1 to 3 parts by weight, particularly preferably in the range of from 0.1 to 1.0 part by weight based on 100 parts by weight of the entire amount of the oil phase components and water, i.e., 100 parts by weight of the entire amount of the components (a), (c) and (e-2). When the amount is below the above-described range, the emulsification of the heavy oil and the development of the emulsification stability are unsatisfactory. On the other hand, when the amount is above the above-described range, the profitability is low and, further, foaming occurs during emulsification or the regulation of the particle diameter becomes difficult.

In the heavy oil emulsion fuel according to the present invention, the amount of introduced water as component (c) is important, and it is preferably varied depending on the ratio of the heavy oil (a) in the oil phase. That is, it is preferable that the ratio of the water to the heavy oil (a) is constant.

In the present invention, if necessary, it is also possible to incorporate a water-soluble polymer (d) and/or a polyhydric alcohol (g) as a stabilizer. The water-soluble polymer (d) having a molecular weight of 10,000 or more can be incorporated in an amount of 0.005 to 3 parts by weight, preferably 0.008 to 2 parts by weight, still preferably 0.01 to 0.5 parts by weight based on 100 parts by weight of the entire amount of the components (a), (b-2), (c) and (e-2) for the purpose of further improving the storage stability. The polyhydric alcohol (g) can be incorporated in an amount of 0.1 to 50 parts by weight, preferably 0.2 to 40 parts by weight, still preferably 0.3 to 30 parts by weight based on 100 parts by weight of the entire amount of the components (a), (b-2), (c) and (e-2) for the purpose of further improving the storage stability.

In the present invention, the edible oil (e-2) can be incorporated by a method wherein the heavy oil (a) and the edible oil (e-2) are mixed or heat-mixed with each other before the production of an emulsion or a method wherein the edible oil (e-2) is added during the production of an emulsion. If necessary, the edible oil (e-2) may be added after the formation of an emulsion comprising a heavy oil (a) and water (c), followed by re-emulsification.

In some cases, the pH of the emulsion to which the edible oil (e-2) has been incorporated is in an acidic range. In this case, it is possible to neutralize the emulsion by adding an alkaline component. A hydroxide of an alkali metal, ammonia or an amine is suitable as the neutralizing agent. The neutralizing agent may be dissolved in water before the production of the emulsion or alternatively may be added during the production of the emulsion. The amount of addition of the neutralizing agent is preferably such that the resultant emulsion is neutral or weakly acidic or weakly alkaline.

The neutralizing agent reacts with the edible oil (e-2) to form a soap. Namely, the neutralizing agent serves also as a saponifier. Therefore, the neutralizing agent is the neutralizing agent or saponifier (f) described above.

When the neutralizing agent is used, the heavy oil emulsion fuel contains (b-1-2) a product obtained by reacting (e-2) an edible oil with (f) a neutralizing agent or saponifier. In this case, the heavy oil emulsion fuel comprises components (a), (c), (e-2) and (b-1-2), or components (a), (c) and (b-1-2), depending on the amount of the neutralizing agent or saponifier (f).

According to the present invention, the contents of the soot and dust and the nitrogen oxides present in the exhaust gases can be reduced through the following mechanism. Asphalts and bitumens as the heavy oil have higher residual carbon and nitrogen contents than those of gas oil, kerosine, fuel oil and other oils generally used as a fuel, so that when they are used as a fuel, an increase in the soot and dust and the nitrogen oxides is unavoidable. By contrast, in the edible oil (e-2) used in the present invention, the calorific value in the combustion is substantially equal to that of the heavy oil, but no significant amount of residual carbon and residual nitrogen is present. Therefore, the fuel $NO_x$ derived from nitrogen contained in the soot and dust and the fuel decreases with the incorporation of an increasing proportion of the edible oil (e-2) relative to the heavy oil (a). However, when the proportion of incorporation of the edible oil (e-2) is increased, the burning off of the fuel is improved and the flame temperature rises, so that the amount of thermal $NO_x$ formed by the oxidation of nitrogen contained in the air is increased. For this reason, the ratio of incorporation of the heavy oil (a) to the edible oil (e-2) is important.

As described above, the high-concentration and low-viscosity emulsion of a heavy oil having a particular particle size distribution with respect to its oil phase according to the present invention is an epoch-making fuel which enables heavy oils, which have not been eFFectively utilized as an energy source in the art, such as bitumen and asphalt, to be used as a substitute fuel for heavy fuel oil. Further, since the fuel according to the present invention has a high heavy oil concentration and, at the same time, a low viscosity close to that of water, it has the great feature of enabling the boilers fired by heavy fuel oil commonly used in the art to be used without any modification. Further, since the heavy oil is in a fine particle form, the combustion efficiency is high and it is possible to reduce the amount of nitrogen oxides and sulfur oxides after combustion.

EXAMPLES

The present invention will now be described in more detail with reference to the following Examples which should not be considered to limit the scope the present invention.

Example I-1

An asphalt (specific gravity: 1.015, viscosity: 595 cP/100° C., softening point: 29° C., penetration: 370/25° C.) obtained from Arabian Light crude oil, a mixture of a nonionic surfactant (polyoxyethylene nonylphenyl ether; Emulgen 921 manufactured by Kao Corp.) with an anionic surfactant (potassium oleate soap; OS Soap manufactured by Kao Corp.) in a ratio of 1:1 and water were weighed in respective amounts necessary for one batch as specified in Table I-1. The oil phase component and the water phase component were mixed with each other at a temperature of 80° C. on a TK homomixer (provided with a low-viscosity agitation blade) manufactured by Tokushu Kika Kogyo Co., Ltd. to provide an emulsion. The number of revolutions of the agitation blade was 10,000 or 5000 rpm, and the agitation time was 1 to 3 min.

Further, emulsions prepared using the number of revolutions of 10000 or 5000 rpm were mixed with each other (by manual mixing for 3 min) in a given mixing ratio as specified in Table I-2 to provide emulsion fuels according to the present invention. Thereafter, the emulsion fuels were allowed to stand in a thermostatic chamber at 20° C. for 24 hr and then subjected to a measurement of particle size, viscosity and storage stability. The results are given in Table I-2.

The methods of measurement were as follows.

Particle size: The particle size was measured with a laser beam diffraction/scattering particle size distribution measuring device (LA700 manufactured by Horiba, Ltd.). The average particle diameter is a volumetric median diameter.

Distribution constant (n): A-particle diameter corresponding to a cumulative oversize weight of 10% and one corresponding to a cumulative oversize weight of 90% were determined based on the results of the measurement of the particle size by fitting, and two relational expressions were obtained by substituting each of the particle diameters for the Rosin-Rammler distribution function, and the following calculation formula was derived from the two relational expressions and the distribution constant was determined by the following calculation formula:

$$n = \frac{-1.34}{\log(\text{particle diameter corresponding to a cumulative oversize weight of 90\%}) - \log(\text{particle diameter corresponding to a cumulative oversize weight of 10\%})}$$

The calculation formula described above is derived from the Rosin-Rammler distribution function expressed by the equation (1) as follows:

$$R_{(D)} = 100 \exp\{-(D/D_C)^n\} \quad (1)$$

$$\log(R_{(D)}/100) = -(D/D_c)^n \cdot \log e$$

$$\log.\log(100/R_{(D)}) = n.\log(D/D_c) + \log.\log e$$

$$\log.\log(100/R_{(D)}) = n.\log D - n.\log D_c + \log.\log e$$

in the case where $R_{(D)} = 90$;

$$\log.\log(100/90) = n.\log D_{90} - n.\log D_c + \log.\log e$$

wherein $D_{90}$ represents a particle diameter (μm) corresponding to a cumulative oversize weight of 90% (A)

in the case where $R_{(D)} = 0$;

$$\log.\log(100/10) = n.\log D_{10} - n.\log D_c + \log.\log e$$

wherein $D_{10}$ represents a particle diameter (μm) corresponding to a cumulative oversize weight of 10% (B)

solve the simultaneous equations (A) and (B) to eliminate $D_c$;

$$n = \frac{-1.34}{\log(\text{particle diameter corresponding to a cumulative oversize weight of 90\%}) - \log(\text{particle diameter corresponding to a cumulative oversize weight of 10\%})}$$

Viscosity: The viscosity was measured with a Brookfield viscometer (model BM) manufactured by Tokyo Keiki Co., Ltd. using rotors Nos. 3 and 4 at 60 rpm at 25° C. one min after the initiation of rotation.

Stability: the state of the emulsion fuel in a sedimentation test tube (capacity: 100 cc) was observed one month after the initiation of standing at 25° C. to evaluate the separation of water on the surface layer according to 3 ranks, i.e. "none", "somewhat" (1 to 5 mm), and "significant" (above 5 mm), and the sedimentation in the lower layer according to 3 ranks, i.e. "none", "somewhat" (1 to 5 mm), and "significant" (above 5 mm). When the emulsion fuel did not have fluidity at ordinary temperatures, the state was expressed as "gelation".

Solid concentration: The weight of a cup made of aluminium (A mg) was measured precisely and then an emulsion fuel was poured into the cup. The total weight of the cup and the emulsion fuel (B mg) was measured precisely. The cup was allowed to stand in a drying box at 110° C. for 5 hr and then in a desiccator for 5 min to cool the cup to room temperature. The total weight of the cup and the residue of the emulsion fuel (C mg) was measured precisely and the solid concentration was calculated according to the following formula:

Solid concentration (%)={(C-A)/(B-A)}X100

TABLE I-1

| | Mixing and emulsification conditions | | | | |
|---|---|---|---|---|---|
| | Asphalt | Surfactant | Water | No. of revolutions of blade | Agitation time |
| Condition A | 222 g | 3.0 g | 75 g | 10000 rpm | 3 min |
| Condition B | 246 g | 3.0 g | 51 g | 5000 rpm | 1 min |
| Condition C | 228 g | 3.0 g | 69 g | 5000 rpm | 1 min |

n, was so large that the viscosity was very high and the storage stability was also unsatisfactory.

In Experiment No. 3 as a comparative example, since the average particle diameter was excessively large, the amount of particles having a diameter of 100 μm or less was excessively small and the distribution constant, n, was large, the viscosity was very high and the storage stability was also unsatisfactory, so that a large amount of coarse particles precipitated one month after the initiation of standing.

By contrast, in Experiments Nos. 4 to 6 of the invention, since the average particle diameter, the proportion of particles having a diameter of 100 μm or less, the proportion of particles having a diameter of 1 μm or less and the distribution constant, n, were regulated to fall within the optimal particle size distribution range, the viscosities were 1000 cP or less despite a very high heavy oil concentration of about 80%, and the stabilities remained very good even one month after the initiation of standing.

TABLE I-2

| | | Emulsion preparation conditions | Mixing ratio | Solid concn. (%) | Results of measurement: Particle size distribution: av. particle diam. | 100 μm or less | 1 μm or less | Distribution const. n | Viscosity (cP) | Stability (after 1 month): upper layer | lower layer |
|---|---|---|---|---|---|---|---|---|---|---|---|
| Comp. Ex. | 1 | A | — | 78.8 | 2.8 μm | 98.6% | 15.4% | 1.82 | 9800 | gelation | gelation |
| | 2 | B | — | 81.9 | 19.0 μm | 95.3% | 2.5% | 1.89 | 7200 | significant | significant |
| | 3 | C | — | 83.8 | 32.9 μm | 67.2% | 0.3% | 1.78 | 2700 | somewhat | gelation |
| Invention | 4 | A/B | 50/50 | 80.5 | 11.2 μm | 96.8% | 6.8% | 1.24 | 820 | none | none |
| | 5 | A/C | 50/50 | 81.2 | 16.7 μm | 83.0% | 5.1% | 1.20 | 750 | none | none |
| | 6 | A/B/C | 33/34/33 | 80.8 | 12.9 μm | 85.2% | 4.3% | 1.15 | 420 | none | none |

As is apparent from the results of measurement given in Table I-2, in Experiment No. 1 as a comparative example, since the average particle diameter was excessively small, the proportion of particles having a diameter of 1 μm or less was excessively high and the distribution constant, n, was excessively large, the viscosity was very high and the storage stability was unsatisfactory, so that the whole system gelled and lost the fluidity one month after the initiation of standing.

In Experiment No. 2 as a comparative example, although the average particle diameter, the amount of particles having a diameter of 100 μm or less and the amount of particles having 1 μm or less fell within the scope of the present invention, the distribution constant,

Example I-2

An emulsion fuel was prepared by using the same asphalt as that of Example I-1, a nonionic surfactant (polyoxyethylene nonylphenyl ether, (a mixture of Emulgen 913 with Emulgen 920 (1/1), manufactured by Kao Corp.) and water on a line mixer (model PL-SL) manufactured by Tokushu Kika Kogyo Co., Ltd. More specifically, 800 g of the asphalt, 200 g of water and 10 g of the surfactant were weighed for one batch and premixed by manual stirring at a temperature of 80° C., and the mixture was emulsified on a line mixer.

Emulsification conditions are given in Table I-3, and various characteristics of the emulsion fuel as a fuel are given in Table I-4. The measurement conditions are the same as those of Example I-1.

TABLE I-3

| | Emulsification conditions | | |
|---|---|---|---|
| Expt. No. | No. of revolutions of mixer (rpm) | Emulsification time on line mixer (min) | Emulsion withdrawal method |
| 1 | 4000 | 10 | withdrawal in bulk after emulsification |
| 2 | 6000 | 7 | withdrawal in bulk after emulsification |
| 3 | 8000 | 5 | withdrawal in bulk after emulsification |
| 4 | 4000 | 10 | continuous withdrawal in portions during emulsification (100 cc/min) |
| 5 | 6000 | 7 | continuous withdrawal in portions during emulsification (140 cc/min) |
| 6 | 8000 | 5 | continuous withdrawal in portions during emulsification (200 cc/min) |

TABLE I-4

| Expt. No. | | Results of measurement: Particle size distribution: av. particle diam. | 100 μm or less | 1 μm or less | distribution constant, n | Viscosity (cP) | Stability (after 1 month): upper layer | lower layer |
|---|---|---|---|---|---|---|---|---|
| Comp. Ex. | 1 | 12.8 μm | 98.1 | 7.7 | 1.64 | 7600 | gelation | gelation |
| | 2 | 12.1 μm | 98.7 | 7.9 | 1.70 | 8300 | gelation | gelation |
| | 3 | 10.5 μm | 99.2 | 8.0 | 1.88 | 9700 | gelation | gelation |
| Invention | 4 | 14.3 μm | 95.4 | 5.3 | 1.19 | 690 | none | none |
| | 5 | 13.8 μm | 95.7 | 4.9 | 1.33 | 850 | none | none |
| | 6 | 11.4 μm | 94.2 | 5.5 | 1.37 | 950 | none | none |

As is apparent from Table I-4, in Experiments Nos. 1 to 3, although the measurements of the average particle diameter, the proportion of particles having a diameter of 100 μm or less and the proportion of particles having a diameter of 1 μm or less fell within the scope of the present invention, the distribution constants, n, in respective examples were as large as 1.64, 1.70 and 1.88, suggesting a sharp particle size distribution. Therefore, the viscosities of the emulsion fuels were very high and ranged from 7000 to 10000 cP, which rendered these emulsion fuels unsuitable as a substitute fuel for heavy fuel oil. With respect to the storage stability as well, the emulsion fuels gelled one month after the initiation of the standing, so that the practicability of these emulsion fuels was poor.

By contrast, in Experiments Nos. 4 to 6, all the measurements of the average particle diameter, the proportion of particles having a diameter of 100 μm or less, the particles having a diameter of 1 μm or less and the distribution constant, n, were each an intended value, so that the viscosities were 1000 cP or less despite a very high heavy oil concentration of about 80% and the storage stabilities were on a practically satisfactory level.

Example I-3

Orinoco tar (specific gravity: 0.99, viscosity: 23500 cSt/50° C.) produced around the Orinoco river in Venezuela was used as the heavy oil, and 750 g of Orinoco tar, 250 g of water, 10 g of a nonionic surfactant (polyoxyethylene nonylphenyl ether, a mixture of Emulgen 913 with Emulgen 920 (1/1), manufactured by Kao Corp.) and, as a water-soluble polymer for use in combination with the above-described components, polyvinyl alcohol (PVA220 manufactured by Kuraray Co., Ltd.), hydroxyethyl-cellulose (HEC SP-500 manufactured by Daicel Chemical Industries, Ltd.) or xanthan gum (Kelzan manufactured by Sankyo Co., Ltd.) in an amount specified in Table I-5 were used for one batch.

Emulsion fuels were produced under the same emulsification conditions as those of Experiments Nos. 3 and 6 of Example I-2. The water-soluble polymer was dissolved in water together with the surfactant.

Measurement conditions were the same as those of Example I-1, and the stability was measured 1 month and 6 months after the initiation of standing. The results are given in Table I-6.

TABLE I-5

| | Expt. No. | Emulsification conditions: No. of revolutions of mixer (rpm) | Emulsification time on line mixer (min) | Emulsion withdrawal method | Water-soluble polymer: Name | amt. of use (g) |
|---|---|---|---|---|---|---|
| Comp. Ex. | 1 | 8000 | 5 | withdrawal in bulk after emulsification | — | — |
| | 2 | 8000 | 5 | withdrawal in bulk after emulsification | PVA 220 | 1 |
| Invention | 3 | 8000 | 5 | continuous withdrawal in portions during emulsification (200 cc/min) | — | — |
| | 4 | 8000 | 5 | continuous withdrawal in portions during emulsification (200 cc/min) | PVA 220 | 1 |
| | 5 | 8000 | 5 | continuous withdrawal in portions during emulsification (200 ec/min) | HEC SP-500 | 1 |
| | 6 | 8000 | 5 | continuous withdrawal in portions during emulsification (200 cc/min) | Kelzan | '0.5 |

TABLE I-6

| Expt. No. | | Results of measurement: Particle size distribution: av. particle diam. | 100 μm or less | 1 μm or less | distribution constant, n | Viscosity (cP) | Stability (after 1 month): upper layer | lower layer | Stability (after 6 months): upper layer | lower layer |
|---|---|---|---|---|---|---|---|---|---|---|
| Comp. Ex. | 1 | 8.5 μm | 98.7 | 9.5 | 1.83 | 1550 | somewhat | none | significant | somewhat |
| | 2 | 7.6 μm | 99.3 | 11.2 | 1.85 | 1820 | none | none | none | gelation |
| Invention | 3 | 9.8 μm | 96.2 | 7.0 | 1.31 | 310 | somewhat | none | somewhat | somewhat |
| | 4 | 8.3 μm | 98.1 | 8.3 | 1.40 | 380 | none | none | none | none |
| | 5 | 8.0 μm | 97.8 | 8.1 | 1.42 | 410 | none | none | none | none |
| | 6 | 7.7 μm | 98.5 | 9.0 | 1.46 | 400 | none | none | none | none |

As is apparent from the experimental results given in Table I-6, in both Experiments Nos. 1 and 2 as comparative examples, since the distribution constants were larger than 1.8, a sharp particle size distribution is suggested. Therefore, in both experiments, the viscosities of the emulsion fuels were as high as 1500 cP or more so that the emulsion fuels deviated from the object of the present invention wherein an emulsion fuel as contemplated in the present invention has a low viscosity although the heavy oil concentration is high. Further, the stabilities were also unsatisfactory because the separation of water or agglomeration and sedimentation or gelation occurred 6 months after the initiation of standing.

On the other hand, in all of Experiments Nos. 3 to 6 of the invention, since the distribution constants were smaller than 1.8, the particle size distributions of the oil phase were broad. As a result, although the emulsion fuels had a heavy oil concentration as high as about 75%, the viscosities were as low as 500 cP or less, suggesting that the emulsion fuels had optimal properties. Further, the combined use of a water-soluble polymer contributed to a further improvement in the emulsion stability, and the emulsion fuels brought about neither separation of water nor agglomeration/precipitation of particles even 6 months after the initiation of standing, which demonstrated that they were a very excellent emulsion fuel. Example II-1

An emulsion fuel was produced from an asphalt (specific gravity: 1.015, viscosity: 595 cP/100° C., softening point: 29° C., penetration: 370/25° C.) obtained from Arabian Light crude oil by using, as an emulsifier, a TK homomixer (provided with a low-viscosity agitation blade) manufactured by Tokushu Kika Kogyo Co., Ltd. 225 g of the asphalt and 75 g of water were weighed for one batch and heated to 90° C. As specified in Table II-1-A, 6.0 g (total weight) of an additive(s) (a surfactant, a precursor and a basic compound) was weighed for one batch, and the surfactant and basic compound were dissolved in water, while the precursor was dissolved in the asphalt. The properties of the precursors are specified in Table II-1-B. After the completion of the dissolution, the asphalt, i.e., the oil phase components, and water, i.e., the water phase components, were put in a stainless vessel for emulsification and mixed by manual stirring for one min. Subsequently, the vessel for emulsification was put on a water bath at 90° C., and emulsification with a mixer was initiated. The number of revolutions of the mixer and the emulsification time were 8000 rpm and 5 min, respectively.

Various characteristics of the emulsion fuel as a fuel are given in Table II-2. The measurement conditions are the same as those of Example I-1.

TABLE II-1-A

| Expt. No. | | Additives used: Name of additives | Amt. of use (g) |
|---|---|---|---|
| Comp. Ex. | 1 | mixed fatty acid soda soap (Flake Marceilles manufactured by Kao Corp.) | 6.0 |
| | 2 | oleic acid potash soap (OS soap manufactured by Kao Corp.) | 6.0 |
| | 3 | tallow fatty acid soda soap (NS soap manufactured by Kao Corp) | 6.0 |
| Invention Ex. | 4 | coconut oil/sodium hydroxide | 4.5/1.5 |
| | 5 | tallow/sodium hydroxide | 4.5/1.5 |
| | 6 | palm oil/potassium hydroxide | 4.5/1.5 |
| | 7 | tall oil/potassium hydroxide | 4.5/1.5 |
| | 8 | oleic acid/potassium hydroxide | 4.5/1.5 |
| | 9 | stearic acid/potassium hydroxide | 4.5/1.5 |
| | 10 | stearic acid/ammonia | 4.5/1.5 |
| | 11 | stearic acid/triethanolamine | 4.5/1.5 |
| | 12 | abietic acid/potassium hydroxide | 4.5/1.5 |
| | 13 | naphthenic acid/potassium hydroxide | 4.5/1.5 |

Note: carboxylic acids and basic compounds are reagents manufactured by Wako Pure Chemical Industries Ltd.

TABLE II-1-B

| | Properties of fat and oil used: sp. gr. | m.p. (°C.) | sapon. value | iodine value |
|---|---|---|---|---|
| coconut oil | 0.92 | 24 | 261 | 11 |
| beef tallow | 0.94 | 42 | 196 | 42 |
| palm oil | 0.93 | 38 | 203 | 50 |
| tall oil | 0.93 | — | 199 | — |

TABLE II-2

| Expt. No. | | Results of measurement: Particle size distribution: av. particle diam. | 100 μm or less | 1 μm or less | distribution const. n | Viscosity (cP) | Stability (after 1 month): upper layer | lower layer |
|---|---|---|---|---|---|---|---|---|
| Comp. Ex. | 1 | 6.7 μm | 98.2% | 12.0% | 1.84 | 1740 | none | none |
| | 2 | 5.0 μm | 98.3% | 15.8% | 1.90 | 2560 | none | none |
| | 3 | 8.5 μm | 99.7% | 13.2% | 1.88 | 1980 | none | none |
| Invention Ex. | 4 | 13.7 μm | 96.3% | 6.1% | 1.29 | 390 | none | none |
| | 5 | 12.2 μm | 96.7% | 5.8% | 1.25 | 370 | none | none |
| | 6 | 11.6 μm | 94.9% | 5.5% | 1.27 | 380 | none | none |
| | 7 | 9.1 μm | 98.1% | 7.6% | 1.19 | 380 | none | none |
| | 8 | 11.3 μm | 95.4% | 7.4% | 1.52 | 650 | none | none |
| | 9 | 13.5 μm | 96.8% | 8.1% | 1.59 | 700 | none | none |
| | 10 | 14.9 μm | 95.3% | 6.6% | 1.52 | 590 | none | none |
| | 11 | 12.5 μm | 95.1% | 5.9% | 1.55 | 550 | none | none |
| | 12 | 11.6 μm | 94.5% | 5.7% | 1.52 | 560 | none | none |
| | 13 | 13.4 μm | 96.0% | 6.8% | 1.51 | 470 | none | none |

As is apparent from the results of the measurement given in Table II-2, in Experiment Nos. 1 to 3 as comparative examples wherein use was made of an anionic surfactant, the distribution constant, n, was as large as 1.8, a sharp particle size distribution is suggested.

Therefore, in each of these experiments, the viscosity of the emulsion fuel was as high as about 2000 cP, so that the emulsion fuel deviated from the object of the present invention wherein an emulsion fuel as contemplated in the present invention has a low viscosity although the heavy oil concentration is high.

By contrast, in Experiment Nos. 4 to 13 of the present invention, the emulsion fuels had a broad distribution having a distribution constant, n, of 1.8 or less. As a result, each of the emulsion fuels had a viscosity of 1000 cP or less, i.e., attained the object of the present invention. Further, also in respect of the stability after one month, neither separation nor precipitation occurred despite the low viscosity.

Example II-2

An emulsion fuel was produced in the same manner as that of Example II-1, except that Orinoco tar (specific gravity: 0.99, viscosity: 23500 cSt/50° C.) produced around the Orinoco river in Venezuela was used as the heavy oil, and, in addition, a nonionic surfactant (polyoxyethylene nonylphenyl ether; Emulgen 920 manufactured by Kao Corp.), and polyvinyl alcohol (PVA 220 manufactured by Kuraray Co., Ltd.), hydroxyethylcellulose (HECSP-500 manufactured by Daicel Chemical Industries, Ltd.), xanthan gum (Kelzan manufactured by Sansho Corp.) and polyethylene glycol (MW: 20000; manufactured by Wako Pure Chemical Industries Ltd.) as water-soluble polymers were also used.

The kind and amount of addition of additives used are as specified in Tables II-3 and II-4, and various characteristics of the emulsion fuel as a fuel are given in Tables II-5 and II-6. The measurement conditions are the same as those of Example I-1. Among the items of measurement, the stability was measured one month and 6 months after the initiation of standing.

TABLE II-3

| Expt. No. | | Additives used: Name of additives | Amt. of use (g) |
|---|---|---|---|
| Comp. | 1 | tallow fatty acid soda soap | 6.0 |
| Ex. | 2 | mixed fatty acid soda soap | 6.0 |
| | 3 | tallow fatty acid soda soap/nonionic surfactant | 3.0/3.0 |
| | 4 | mixed fatty acid soda soap/nonionic surfactant | 3.0/3.0 |
| | 5 | oleic acid potash soap/nonionic surfactant | 3.0/3.0 |
| | 6 | tallow soda soap/nonionic surfactant/PVA220 | 3.0/3.0/0.3 |
| Invention | 7 | coconut oil/sodium hydroxide | 4.5/1.5 |
| Ex. | 8 | tall oil/potassium hydroxide | 4.5/1.5 |
| | 9 | coconut oil/sodium hydroxide/nonionic surfactant | 2.3/0.8/3.0 |
| | 10 | beef tallow/sodium hydroxide/nonionic surfactnat | 2.3/0.8/3.0 |
| | 11 | palm oil/potassium hydroxide/nonionic surfactant | 2.3/0.8/3.0 |
| | 12 | tall oil/potassium hydroxide/nonionic surfactant | 2.3/0.8/3.0 |
| | 13 | oleic acid/potassium hydroxide/nonionic surfactant | 2.3/0.8/3.0 |
| | 14 | stearic acid/potassium hydroxide/nonionic surfactant | 2.3/0.8/3.0 |
| | 15 | abietic acid/potassium hydroxide/nonionic surfactant | 2.3/0.8/3.0 |
| | 16 | naphthenic acid/potassium hydroxide/nonionic surfactant | 2.3/0.8/3.0 |

TABLE II-4

| Expt. No. | | Additives used: Name of additive | Amt. of use (g) |
|---|---|---|---|
| Invention | 17 | beef tallow/sodium hydroxide/nonionic surfactant/PVA220 | 2.3/0.8/3.0/0.3 |
| Ex. | 18 | beef tallow/sodium hydroxide/nonionic surfactant/HECSP-500 | 2.3/0.8/3.0/0.3 |
| | 19 | beef tallow/sodium hydroxide/nonionic surfactant/Kelzan | 2.3/0.8/3.0/0.15 |
| | 20 | beef tallow/sodium hydroxide/nonionic surfactant/ polyethylene glycol | 2.3/0.8/3.0/0.3 |
| | 21 | coconut oil/sodium hydroxide/nonionic surfactant/PVA220 | 2.3/0.8/3.0/0.3 |
| | 22 | palm oil/potassium hydroxide/nonionic surafactant/PVA220 | 2.3/0.8/3.0/0.3 |
| | 23 | tall oil/potassium hydroxide/nonionic surfactant/PVA220 | 2.3/0.8/3.0/0.3 |
| | 24 | oleic acid/potassium hydroxide/nonionic surfactant/PVA220 | 2.3/0.8/3.0/0.3 |
| | 25 | stearic acid/potassium hydroxide/ nonionic surfactant/PVA220 | 2.3/0.8/3.0/0.3 |
| | 26 | abietic acid/potassium hydroxide/ nonionic surfactant/PVA220 | 2.3/0.8/3.0/0.3 |
| | 27 | napthenic acid/potassium hydroxide/ nonionic surfactant/PVA220 | 2.3/0.8/3.0/0.3 |

TABLE II-5

| Expt. No. | | Results of measurement: Particle size distribution: av. particle diam. | 100 μm or less | 1 μm or less | distribution const. n | Viscosity (cP) | Stability (after 1 month): upper layer | lower layer | Stability (after 6 months): upper layer | lower layer |
|---|---|---|---|---|---|---|---|---|---|---|
| Comp. | 1 | 7.5 μm | 98.0 | 11.0 | 1.83 | 1240 | none | none | significant | somewhat |
| Ex. | 2 | 6.8 μm | 98.7 | 10.8 | 1.90 | 1220 | none | none | significant | somewhat |
| | 3 | 4.9 μm | 99.2 | 12.7 | 1,89 | 1370 | none | none | somewhat | none |
| | 4 | 4.6 μm | 99.5 | 13.3 | 1.92 | 1450 | none | none | somewhat | none |
| | 5 | 3.8 μm | 99.3 | 15.8 | 1.90 | 1380 | none | none | somewhat | none |
| | 6 | 3.3 μm | 99.6 | 17.1 | 1.97 | 2310 | none | none | none | gelation |
| Inven- | 7 | 10.3 μm | 97.0 | 8.7 | 1.15 | 260 | none | none | somewhat | somewhat |
| tion | 8 | 11.5 μm | 96.9 | 8.5 | 1.13 | 240 | none | none | somewhat | somewhat |

TABLE II-5-continued

| Expt. No. | | Results of measurement: Particle size distribution: av. particle diam. | 100 μm or less | 1 μm or less | distribution const. n | Viscosity (cP) | Stability (after 1 month): upper layer | lower layer | Stability (after 6 months): upper layer | lower layer |
|---|---|---|---|---|---|---|---|---|---|---|
| Ex. | 9 | 8.8 μm | 97.2 | 9.2 | 1.27 | 350 | none | none | somewhat | none |
| | 10 | 9.0 μm | 96.8 | 9.0 | 1.27 | 370 | none | none | somewhat | none |
| | 11 | 8.9 μm | 98.5 | 9.7 | 1.25 | 330 | none | none | somewhat | none |
| | 12 | 8.2 μm | 99.0 | 10.3 | 1.18 | 280 | none | none | somewhat | none |
| | 13 | 7.7 μm | 98.0 | 12.5 | 1.47 | 520 | none | none | somewhat | none |
| | 14 | 7.5 μm | 97.8 | 11.0 | 1.40 | 580 | none | none | somewhat | none |
| | 15 | 7.8 μm | 98.1 | 12.2 | 1.39 | 490 | none | none | somewhat | none |
| | 16 | 6.9 μm | 98.2 | 11.5 | 1.49 | 510 | none | none | somewhat | none |

TABLE II-6

| Expt. No. | | Results of measurement: Particle size distribution: av. particle diam. | 100 μm or less | 1 μm or less | distribution const. n | Viscosity (cP) | Stability (after 1 month): upper layer | lower layer | Stability (after 6 months): upper layer | lower layer |
|---|---|---|---|---|---|---|---|---|---|---|
| Invention | 17 | 7.5 μm | 99.0 | 12.0 | 1.33 | 650 | none | none | none | none |
| Ex. | 18 | 6.9 μm | 99.1 | 11.7 | 1.29 | 670 | none | none | none | none |
| | 19 | 7.2 μm | 98.6 | 12.5 | 1.35 | 790 | none | none | none | none |
| | 20 | 6.8 μm | 98.8 | 12.7 | 1.38 | 570 | none | none | none | none |
| | 21 | 7.8 μm | 98.0 | 11.4 | 1.42 | 570 | none | none | none | none |
| | 22 | 7.5 μm | 99.2 | 12.5 | 1.48 | 590 | none | none | none | none |
| | 23 | 7.0 μm | 98.8 | 11.5 | 1.45 | 630 | none | none | none | none |
| | 24 | 6.2 μm | 98.6 | 12.7 | 1.55 | 780 | none | none | none | none |
| | 25 | 6.9 μm | 99.0 | 13.4 | 1.49 | 750 | none | none | none | none |
| | 26 | 5.9 μm | 99.3 | 12.2 | 1.50 | 750 | none | none | none | none |
| | 27 | 6.6 μm | 99.6 | 14.0 | 1.51 | 770 | none | none | none | none |

As is apparent from the results of measurement given in Tables II-5 and II-6, in each of the Experiments Nos. 1 to 6 as a comparative example, the distribution constant, n, was larger than 1.8, a sharp particle size distribution is suggested. Therefore, in each of these experiments, the viscosity of the emulsion fuel was as high as 1000 cP or more, so that the emulsion fuel deviated from the object of the present invention wherein an emulsion fuel as contemplated in the present invention has a low viscosity although the heavy oil concentration is high. Further, the stability was also unsatisfactory because separation of water or agglomeration and sedimentation or gelation occurred six months after the initiation of the standing.

On the other hand, in each of Experiments Nos. 7 to 27 of the invention, the distribution constant, n, was smaller than 1.8, so that the particle size distribution of the oil phase was broad. As a result, although each of the emulsion fuels had a heavy oil concentration as high as about 75%, the viscosity was as low as 1000 cP or less, suggesting that the emulsion fuels had optimal properties. Further, the combined use of a water-soluble polymer contributed to a further improvement in the emulsion stability, and the emulsion fuels brought about neither separation of water nor agglomeration/precipitation of particles even six months after the initiation of standing, which demonstrated that they were very excellent emulsion fuels.

Example III-1

The following materials were used as the raw materials for producing a heavy oil emulsion fuel:

asphalt: obtained from Arabian Light crude oil (specific gravity: 1.015, viscosity: 595 cP/100° C, softening point: 29° C, penetration: 370/25° C)

water: deionized water nonionic surfactant: polyoxyethylene nonylphenyl ether (Emulgen 921 manufactured by Kao Corp.)

anionic surfactant: formaldehyde condensate of naphthalenesulfonic acid (Mighty 150 manufactured by Kao Corp.)

fatty acid distillation bottom: obtained in WAKAYAMA Factory of Kao Corp.;

composition: fatty acids=69% by weight, fatty acid esters=25% by weight, others=6% by weight;

acid value=154.8 KOH mg/g;

saponification value=213.6 KOH mg/g;

hydroxyl value=4.0 KOH mg/g stabilizer: carboxymethylcellulose (CMC1190 manufactured by Daicel Chemical Industries, Ltd.)

neutralizing agent: potassium hydroxide (a reagent manufactured by Wako Pure Chemical Industries Ltd.)

The above-descried raw materials were weighed as specified in Table III-1 and heated at 80° C. Thereafter, the fatty acid distillation bottom was dissolved in asphalt, and the stabilizer and neutralizing agent were dissolved in water. Thereafter, while maintaining the temperature at 80° C., emulsion fuels were prepared by using a TK homomixer (provided with a low-viscosity agitation blade) manufactured by Tokushu Kika Kogyo Co., Ltd. under a number of revolutions of the agitation blade of 8000 rpm and an agitation time of 3 min.

Various characteristics of the emulsion fuel as a fuel are given in Table III-2. The measurement conditions are the same as those of Example I-1, except for stability. For the evaluation of the stability of the emulsion fuel, the state of the emulsion fuel in a sedimentation test tube (capacity: 100 cc) was observed one month after the initiation of standing at 25° C. to evaluate the skinning on the surface layer according to 3 ranks, i.e. "none", "somewhat", and "significant", the separation of water on the surface layer according to 3 ranks, i.e. "none", "somewhat" (1 to 5 mm), and "significant" (above 5 mm), and the sedimentation in the lower layer according to 3 ranks, i.e. "none", "somewhat" (1 to 5 mm), and "significant" (above 5 mm).

TABLE III-1

| | Expt. No. | Asphalt (g) | Water (g) | Nonionic surfactant (g) | Anionic surfactant (g) | Fatty acid distillation bottom (g) | Stabilizer (g) | Neutralizing agent (g) |
|---|---|---|---|---|---|---|---|---|
| | | Compositions | | | | | | |
| Comp. Ex. | 1 | 210 | 90 | 1.5 | 1.5 | — | — | — |
| Inven-tion | 2 | 207 | 90 | 1.5 | 1.5 | 3.0 | — | — |
| | 3 | 180 | 90 | 1.5 | 1.5 | 30.0 | — | — |
| | 4 | 207 | 90 | 1.5 | 1.5 | 3.0 | 0.3 | — |
| | 5 | 180 | 90 | 1.5 | 1.5 | 30.0 | 0.3 | — |
| | 6 | 180 | 90 | 1.5 | 1.5 | 30.0 | — | 6.0 |
| | 7 | 180 | 90 | 1.5 | 1.5 | 30.0 | 0.3 | 6.0 |

TABLE III-2

| | Expt. No. | Av. particle diam. (μm) | Viscosity (cP) | Stability: skinning | Stability: water separation | Stability: sedimentation |
|---|---|---|---|---|---|---|
| | | Results of measurement | | | | |
| Comp. Ex. | 1 | 7.5 | 830 | none | none | none |
| Invention Ex. | 2 | 8.0 | 810 | none | none | none |
| | 3 | 7.8 | 960 | none | none | none |
| | 4 | 7.2 | 930 | none | none | none |
| | 5 | 7.1 | 990 | none | none | none |
| | 6 | 8.3 | 650 | none | none | none |
| | 7 | 7.7 | 840 | none | none | none |

As is apparent from the results of the measurement of the stability given in Table III-2, in Experiment No. 1 as a comparative example wherein no fatty acid distillation bottom was incorporated, one month after the initiation of standing, water separation occurred on the surface of the emulsion fuel and sedimentation was observed at the bottom of the emulsion fuel, so that it was thought that this emulsion fuel had a poor stability.

By contrast, in the systems of Experiment Nos. 2 to 7 of the present invention wherein a fatty acid distillation bottom, or a fatty acid distillation bottom and a stabilizer and/or a neutralizing agent were incorporated, the standing stabilities were very good and, even one month after the initiation of standing, neither water separation nor sedimentation on the bottom of the emulsion fuel occurred, so that it was thought that these emulsion fuels had an excellent stability.

Example III-2

About 4000 kg of an emulsion fuel was prepared using the same raw materials and mixing ratio as those in the production of one of the emulsions in Example III-1. The emulsion fuel produced was subjected to a combustion test.

Specifically, the asphalt, water, the surfactant, the fatty acid distillation bottom, the stabilizer and the neutralizing agent were each heated to 80° C. and fed into a reaction vessel (vessel diameter: 1.9 m) having a capacity of 5 $m^3$, and the mixture was agitated at 80° C. for 60 min. A Pfaudler impeller was used as the agitation blade, and the diameter and number of revolutions of the blade were 1.1 m and 64 rpm, respectively. After the completion of the premixing, the mixture was emulsified by using a PL-SL line mixer manufactured by Tokushu Kika Kogyo Co., Ltd. according to a batch circulation system. The number of revolutions of the mixer and the emulsification time were 3600 rpm and 4 hr, respectively. After the completion of the emulsification, the system was cooled to 20° C. over a period of about 10 hr to provide an emulsion fuel for a combustion test.

In the combustion test, a horizontal cylindrical double-wall water cooling experimental furnace (1.2 mϕ×3.4 ml; manufactured by Nippon Furnace Kogyo Kabushiki Kaisha) was used to measure the content of oxygen, the content of the soot and dust (JIS Z 8808) and the content of the nitrogen oxides (JIS K 0104) present in the exhaust gas. The results are given in Table III-3.

Combustion conditions were as follows:

burner: internal mixing type (manufactured by Nippon Furnace Kogyo Kabushiki Kaisha)

atomizing steam: temp.=170° C., flow rate=60 l/hr, pressure=4.3 kg/$cm^2$ emulsion fuel: temp. =50° C., flow rate=150 l/hr, pressure=3.8 kg/$cm^2$ air flow rate: 1230 $m^3$/hr

TABLE III-3

| | Expt. No. | Av. particle diam. (μm) | Viscosity (cP) | Exhaust gas: oxygen (%) | Exhaust gas: content of soot and dust (g/$m^3$) | Exhaust gas: content of nitrogen oxides (ppm) |
|---|---|---|---|---|---|---|
| | | Results of combustion test | | | | |
| Comp. Ex. | 1 | 13.7 | 790 | 4.0 | 0.16 | 254 |
| Invention | 2 | 14.5 | 700 | 4.1 | 0.11 | 226 |

TABLE III-3-continued

| | Expt. No. | Av. particle diam. (μm) | Viscosity (cP) | Results of combustion test: Exhaust gas: oxygen (%) | content of soot and dust ($g/m^3$) | content of nitrogen oxides (ppm) |
|---|---|---|---|---|---|---|
| Ex. | 3 | 14.5 | 850 | 3.9 | 0.09 | 210 |
| | 4 | 13.1 | 860 | 3.9 | 0.10 | 235 |
| | 5 | 13.0 | 940 | 4.0 | 0.08 | 217 |
| | 6 | 15.9 | 670 | 4.1 | 0.07 | 216 |
| | 7 | 13.6 | 820 | 3.9 | 0.07 | 203 |

As is apparent from the results of the combustion test given in Table III-3, in the emulsion fuel of Experiment No. 1 as a comparative example wherein no fatty acid distillation bottom was incorporated, the content of the soot and dust and that of nitrogen oxides were 0.16 $g/m^3$ and 254 ppm, respectively.

By contrast, in the emulsion fuels of Experiments Nos. 2 to 7 according to the present invention wherein a fatty acid distillation bottom, or a fatty acid distillation bottom and a stabilizer and/or a neutralizing agent were incorporated, the lowering in the content of the soot and dust and that of nitrogen oxides was so large that it was thought that these emulsion fuels were a highly nonpollutive ones. EXAMPLE IV-1

The following materials were used as the raw materials for producing a heavy oil emulsion fuel:

asphalt: one obtained from Arabian Light crude oil (specific gravity: 1.015, viscosity: 595 cP/100° C., softening point: 29° C., penetration: 370/25° C.)

water: deionized water nonionic surfactant: polyoxyethylene nonylphenyl ether (Emulgen 921 manufactured by Kao Corp.)

anionic surfactant: formaldehyde condensate of naphthalenesulfonic acid (Mighty 150 manufactured by Kao Corp.)

recovered oil of edible fat and oil: composition: $C_{18}$=81%, $C_{16}$=10%, $C_{14}$=2%, others=7%; acid value=5.7; saponification value=193.1; iodine value=111.8 stabilizer: carboxymethylcellulose (CMC1190 manufactured by Daicel Chemical Industries, Ltd.)

neutralizing agent: potassium hydroxide (a reagent manufactured by Wako Pure Chemical Industries Ltd.)

The above-descried raw materials were weighed as specified in Table IV-1 and heated at 80° C. Thereafter, the recovered oil of edible fat and oil was dissolved in asphalt, and the stabilizer and neutralizing agent were dissolved in water. Thereafter, emulsion fuels were produced in a similar manner to that of Example III-1.

Various characteristics of the emulsion fuel as a fuel are given in Table IV-2. The measurement conditions are the same as those of Example III-1.

TABLE IV-1

| | Expt. No. | Asphalt (g) | Water (g) | Compositions: Nonionic surfactant (g) | Anionic surfactant (g) | Recovered oil of edible fat and oil (g) | Stabilizer (g) | Neutralizing agent (g) |
|---|---|---|---|---|---|---|---|---|
| Comp. | 1 | 210 | 90 | 1.5 | 1.5 | — | — | — |
| Ex. | 2 | — | 90 | 1.5 | 1.5 | 210 | — | — |
| Invention | 3 | 195 | 90 | 1.5 | 1.5 | 15 | — | — |
| Ex. | 4 | 15 | 90 | 1.5 | 1.5 | 195 | — | — |
| | 5 | 105 | 90 | 1.5 | 1.5 | 105 | — | — |
| | 6 | 105 | 90 | 1.5 | 1.5 | 105 | 0.3 | — |
| | 7 | 105 | 90 | 1.5 | 1.5 | 105 | — | 6.0 |
| | 8 | 105 | 90 | 1.5 | 1.5 | 105 | 0.3 | 6.0 |

TABLE IV-2

| | Expt. No. | Av. particle diam. (μ) | Viscosity (cP) | Results of measurement: Stability: skinning | water separation | sedimentation |
|---|---|---|---|---|---|---|
| Comp. | 1 | 7.5 | 830 | none | significant | somewhat |
| Ex. | 2 | 8.3 | 230 | none | significant | none |
| Invention | 3 | 7.8 | 650 | none | none | none |
| Ex. | 4 | 8.0 | 380 | none | none | none |
| | 5 | 7.5 | 450 | none | none | none |
| | 6 | 7.0 | 530 | none | none | none |
| | 7 | 8.7 | 380 | none | none | none |
| | 8 | 7.8 | 400 | none | none | none |

As is apparent from the results of the measurement of the stability given in Table IV-2, in Experiment No. 1 as a comparative example wherein no recovered oil of an edible fat and oil was incorporated, one month after the initiation of standing, water separation occurred on the surface of the emulsion fuel and sedimentation was observed at the bottom of the emulsion fuel, so that it was thought that this emulsion fuel had a poor stability.

In Experiment No. 2 wherein no heavy oil was incorporated, the specific gravity of water is larger than that of the recovered oil, so that water was separated on the lower part of the emulsion fuel and it was thought that this emulsion fuel had a poor stability.

By contrast, in the systems of Experiment Nos. 3 to 8 of the present invention wherein a recovered oil of an edible fat and oil, or a recovered oil of an edible fat and oil and a stabilizer and/or a neutralizing agent were incorporated, the standing stabilities were very good and, even one month after the initiation of standing, neither water separation nor sedimentation on the bottom of the emulsion fuel occurred, so that it was thought that these emulsion fuels had an excellent stability.

EXAMPLE IV-2

About 4000 kg of an emulsion fuel was prepared in a similar manner to that of Example III-2, except that a recovered oil of an edible fat and oil is substituted for the fatty acid distillation bottom.

The emulsion fuel produced was subjected to a combustion test in a similar manner to that of Example III-2.

The results are given in Table IV-3.

TABLE IV-3

| | | | Results of combustion test | | | |
|---|---|---|---|---|---|---|
| | | | | Exhaust gas | | |
| | Expt. No. | Av. particle diam. (μ) | Viscosity (cP) | oxygen (%) | content of soot and dust ($g/m^3$) | content of nitrogen oxides (ppm) |
| Comp. | 1 | 13.7 | 790 | 4.0 | 0.16 | 254 |
| Ex. | 2 | 15.9 | 180 | 4.0 | 0.05 | 270 |
| Invention | 3 | 14.1 | 450 | 4.0 | 0.12 | 237 |
| Ex. | 4 | 15.4 | 230 | 4.1 | 0.08 | 230 |
| | 5 | 14.7 | 330 | 4.0 | 0.10 | 215 |
| | 6 | 13.8 | 370 | 3.9 | 0.09 | 213 |
| | 7 | 16.4 | 280 | 4.1 | 0.11 | 211 |
| | 8 | 14.0 | 340 | 3.9 | 0.10 | 209 |

As is apparent from the results of the combustion test given in Table IV-3, in the emulsion fuel of Experiment No. 1 as a comparative example wherein no recovered oil of an edible fat and oil was incorporated, the content of the soot and dust and that of nitrogen oxides were 0.16 $g/m^3$ and 254 ppm, respectively.

In the emulsion fuel of Experiment No. 2 wherein no heavy oil was incorporated, an improvement in the burning off of the fuel brought about an increase in the thermal NO due to the rise of the flame temperature, so that the content of the nitrogen oxides comprising the fuel NOx derived from nitrogen contained in the fuel and the thermal NOx formed by the oxidation of nitrogen in the air amounted to was 270 ppm.

By contrast, in the emulsion fuels of Experiments Nos. 3 to 8 according to the present invention wherein a recovered oil of an edible fat and oil, or a recovered oil of an edible fat and oil and a stabilizer and/or a neutralizing agent were incorporated, the lowering in the content of the nitrogen oxides was so large that it was thought that these emulsion fuels were a highly nonpollutive emulsion fuel.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. An oil-in-water heavy oil emulsion fuel comprising (a) a heavy oil, (b) a surfactant and (c) water, wherein oil particles having a diameter of 100 μm or less account for 80% by weight or more of all the oil particles and the oil particles have a particle size distribution such that the distribution constant, n, determined from two relational expressions obtained by substituting a particle diameter (μm) corresponding to a cumulative oversize weight of 10% and a particle diameter (μm) corresponding to a cumulative oversize weight of 90% in a Rosin-Rammler distribution function expressed by the equation (1) is in the range of from 0.5 to 1.6:

$$R_{(D)}=100\exp\{-(D/D_c)^n\} \quad (1)$$

wherein R represents a cumulative oversize weight in %, D represents a particle diameter, n represents a constant (a distribution constant) and $D_c$ represents a constant (a particle size characteristic constant).

2. The oil-in-water heavy oil emulsion fuel according to claim 1, wherein the content of the heavy oil as component (a), the content of the surfactant as component (b) and the content of water as component (c) are 60 to 85% by weight, 0.01 to 5% by weight and 10 to 40% by weight, respectively.

3. The oil-in-water heavy oil emulsion fuel according to claim 1, which further comprises (d) a water-soluble polymer having a molecular weight of 10,000 or more.

4. The oil-in-water heavy oil emulsion fuel according to claim 3, wherein the content of component (d) is 0.005 to 3 parts by weight based on 100 parts by weight of the entire amount of components (a), (b) and (c).

5. The oil-in-water heavy oil emulsion fuel according to claim 1, wherein oil particles having a diameter of 1 μm or less account for 15% by weight or less of all the oil particles.

6. The oil-in-water heavy oil emulsion fuel according to claim 1, wherein the surfactant component (b) is obtained by reacting (e) a precursor of an emulsifier comprising a compound having a carboxyl group in its molecule or an ester with (f) a neutralizing agent or saponifier.

7. The oil-in-water heavy oil emulsion fuel according to claim 6, wherein the precursor (e) of an emulsifier comprises at least one member selected from the group consisting of a chain monocarboxylic acid, a cyclic saturated fatty acid, a diterpenoid carboxylic acid, and a natural fat and oil.

8. The oil-in-water heavy oil emulsion fuel according to claim 6, wherein the precursor (e) of an emulsifier is (e-1) a fatty acid distillation bottom or (e-2) an edible oil.

9. The oil-in-water heavy oil emulsion fuel according to claim 6, wherein the neutralizing agent or saponifier (f) is (f-1) a basic compound.

10. An oil-in-water heavy oil emulsion fuel comprising (a) a heavy oil, (c) water and (e-1) a fatty acid distillation bottom.

11. The oil-in-water heavy oil emulsion fuel according to claim 10, which further comprises a surfactant other than (b-1) a product obtained by reacting (e) a precursor of an emulsifier comprising a compound having a carboxyl group in its molecule or an ester with (f) a neutralizing agent or saponifier, as component (b-2).

12. The oil-in-water heavy oil emulsion fuel according to claim 11, wherein the content of the heavy oil as component (a), the content of the surfactant as component (b-2), the content of water as component (c) and the content of the fatty acid distillation bottom as component (e-1) are 40 to 85% by weight, 0.1 to 5% by weight, 10 to 40% by weight and 0.1 to 50% by weight, respectively.

13. The oil-in-water heavy oil emulsion fuel according to claim 10, which further comprises a surfactant other than (b-1) a product obtained by reacting (e) a precursor of an emulsifier comprising a compound having a carboxyl group in its molecule or an ester with (f) a neutralizing agent or saponifier, as component (b-2), (b-1-1) a product obtained by reacting (e-1) a fatty acid distillation bottom with (f) a neutralizing agent or saponifier, and a water-soluble polymer having a molecular weight of 10,000 or more as component (d) or a polyhydric alcohol as component (g).

14. An oil-in-water heavy oil emulsion fuel comprising (a) a heavy oil, (c) water and (b-1-1) a product obtained by reacting (e-1) a fatty acid distillation bottom with (f) a neutralizing agent saponifier.

15. The oil-in-water heavy oil emulsion fuel according to claim 14, which further comprises a surfactant other than (b-1) a product obtained by reacting (e) a precursor of an emulsifier comprising a compound having a carboxyl group in its molecule or an ester with (f) a neutralizing agent or saponifier, as component (b-2), and a water-soluble polymer having a molecular weight of 10,000 or more as component (d) or a polyhydric alcohol as component (g).

16. An oil-in-water heavy oil emulsion fuel comprising (a) a heavy oil, (c) water and (e-2) an edible oil.

17. The oil-in-water heavy oil emulsion fuel according to claim 16, which further comprises a surfactant other than (b-1) a product obtained by reacting (e) a precursor of an emulsifier comprising a compound having a carboxyl group in its molecule or an ester with (f) a neutralizing agent or saponifier, as component (b-2).

18. The oil-in-water heavy oil emulsion fuel according to claim 17, wherein the ratio of the entire amount of the components (a) and (e-2) to the amount of the component (c) is 60 to 90:40 to 10 by weight and the amount of the component (b-2) is 0.1 to 5% by weight based on the entire amount of the components (a), (c) and (e-2).

19. The oil-in-water heavy oil emulsion fuel according to claim 16, wherein the edible oil (e-2) is a recovered oil of an edible fat and oil.

20. The oil-in-water heavy oil emulsion fuel according to claim 16, which further comprises a surfactant other than (b-1) a product obtained by reacting (e) a precursor of an emulsifier comprising a compound having a carboxyl group in its molecule or an ester with (f) a neutralizing agent or saponifier, as component (b-2), (b-1-2) a product obtained by reacting (e-2) an edible oil with (f) a neutralizing agent or saponifier, and a water-soluble polymer having a molecular weight of 10,000 or more as component (d) or a polyhydric alcohol as component (g).

21. An oil-in-water heavy oil emulsion fuel comprising (a) a heavy oil, (c) water and (b-1-2) a product obtained by reacting (e-2) an edible oil with (f) a neutralizing agent or saponifier.

22. The oil-in-water heavy oil emulsion fuel according to claim 21, which further comprises a surfactant other than (b-1) a product obtained by reacting (e) a precursor of an emulsifier comprising a compound having a carboxyl group in its molecule or an ester with (f) a neutralizing agent or saponifier, as component (b-2), and a water-soluble polymer having a molecular weight of 10,000 or more as component (d) or a polyhydric alcohol as component (g).

23. A process for producing an oil-in-water heavy oil emulsion fuel which comprises producing emulsions different from each other in the particle size distribution by using a plurality of emulsifiers in parallel and operating the emulsifiers with shear forces different from each other, and mixing these emulsions.

24. A process for producing an oil-in-water heavy oil emulsion fuel which comprises producing emulsions different from each other in the particle size distribution by varying the kind and amount of addition of a surfactant and mixing the emulsions.

25. A process for producing an oil-in-water heavy oil emulsion fuel which comprises continuously producing an emulsion on a line mixer while circulating part of the emulsion while regulating the amount and time of circulation.

26. A process for producing an oil-in-water heavy oil emulsion fuel which comprises continuously producing an emulsion on a line mixer while periodically varying the kind or amount of feed, or both of the surfactant while regulating the cycle time according to the kind or amount of feed, or both of the surfactant.

27. A process for producing an oil-in-water heavy oil emulsion fuel which comprises producing an emulsion from 60 to 85% by weight of (a) a heavy oil, 10 to 40% by weight of (c) water, 0.01 to 10% by weight of (e) a precursor of an emulsifier comprising a compound having a carboxyl group in its molecule or an ester, and 0.01 to 5% by weight of (f) a neutralizing agent or saponifier for the precursor (e) while reacting the precursor (e) with the neutralizing agent or saponifier (f) to form an emulsifier.

28. The process for producing an oil-in-water heavy oil emulsion fuel according to claim 27, wherein oil particles having a diameter of 100 μm or less account for 80% by weight or more of all the oil particles in the emulsion and the oil particles in the emulsion have a particle size distribution such that the distribution constant, n, determined from two relational expressions obtained by substituting a particle diameter (μm) corresponding to a cumulative oversize weight of 10% and a particle diameter (μm) corresponding to a cumulative oversize weight of 90% for a Rosin-Rammler distribution function expressed by the equation (1) is in the range of from 0.5 to 1.8:

$$R_{(D)}=100\exp\{-(D/De)^n\} \quad (1)$$

wherein $R_{(D)}$ represents a cumulative oversize weight in %, D represents a particle diameter, n represents a constant (a distribution constant), and De represents a constant (a particle size characteristic constant).

29. The process for producing an oil-in-water heavy oil emulsion fuel according to claim 28, wherein the distribution constant, n, is in the range of from 0.5 to 1.6.

30. The process for producing an oil-in-water heavy oil emulsion fuel according to claim 28, wherein oil particles having a diameter of 1 μm or less account for 15% by weight or less of all the oil particles.

31. The process for producing an oil-in-water heavy oil emulsion fuel according to claim 27, wherein the compound having a carboxyl group in its molecule as the precursor (e) of an emulsifier comprises at least one member selected from the group consisting of a chain monocarboxylic acid, a cyclic saturated fatty acid and a diterpenoid carboxylic acid.

32. The process for producing an oil-in-water heavy oil emulsion fuel according to claim 27, wherein the ester as the precursor (e) of an emulsifier is a natural fat and oil.

33. The process for producing an oil-in-water heavy oil emulsion fuel according to claim 32, wherein the precursor (e) of an emulsifier is (e-1) a fatty acid distillation bottom or (e-2) an edible oil.

34. The process for producing an oil-in-water heavy oil emulsion fuel according to claim 27, wherein the neutralizing agent or saponifier (f) is a basic compound (f-1).

35. An oil-in-water type heavy oil emulsion fuel produced by the process according to claim 27.

36. An oil-in-water heavy oil emulsion fuel produced by the process according to claim 28.

* * * * *